United States Patent [19]

Freeman

[11] 4,213,294

[45] Jul. 22, 1980

[54] ANALOG DISPLAYS FOR ELECTRONIC TIMEPIECES

[76] Inventor: Alfred B. Freeman, 20418 Seaboard Rd., Malibu, Calif. 90265

[21] Appl. No.: 786,962

[22] Filed: Apr. 12, 1977

[51] Int. Cl.[2] ..... G04B 19/30; G04B 19/06

[52] U.S. Cl. ..... 368/82; 368/242

[58] Field of Search ..... 58/23 R, 50 R, 127 R; 350/160 R, 160 LC; 340/336, 324 M, 324 R

[56] References Cited

U.S. PATENT DOCUMENTS

| | | | |
|---|---|---|---|
| 3,540,209 | 11/1970 | Latsky et al. | 58/50 R |
| 3,754,392 | 8/1973 | Daniels | 58/50 R |
| 3,823,549 | 7/1974 | Feldman | 58/50 R |
| 3,844,105 | 10/1974 | Kasho | 58/23 R |
| 3,908,355 | 2/1975 | Wiesner | 58/50 R |
| 3,919,835 | 11/1975 | Kashio | 58/50 R |
| 3,922,847 | 12/1975 | Culley et al. | 58/50 R |
| 3,955,354 | 5/1976 | Kilby et al. | 58/50 R |
| 3,958,409 | 5/1976 | Manber | 58/50 R |
| 3,959,963 | 6/1976 | Murrell | 58/50 R |
| 3,968,639 | 7/1976 | Berets et al. | 58/23 R |
| 3,969,887 | 7/1976 | Fukumoto | 58/50 R |
| 3,987,617 | 10/1976 | Slob | 58/50 R |
| 3,992,875 | 11/1976 | Kashio | 58/50 R |
| 4,007,583 | 2/1977 | Johnson | 58/50 R |
| 4,077,032 | 2/1978 | Volkman | 340/324 R |

*Primary Examiner*—Vit W. Miska

[57] ABSTRACT

A number of analog type time displays for electronic watches and the like use electro-optical elements, such as liquid crystals, to present hour and minute hand positions. The embodiments use 12 and 24 hour elements to show the hour positions and to cooperate with 24 or 60 minute elements to show the minute positions. One set of embodiments uses 24 minute elements in combination with 12 or 24 hour elements to show 24 minute hand positions and, additionally, to indicate the other 36 minute positions as one minute before or after the 24 minute hand positions by periodically turning on the before or after adjacent minute element. Another set of embodiments uses 60 minute elements shaped to combine with 12 or 24 hour elements to form 60 different minute hands. The hour elements in the latter set are shaped to effectively function as part of 2, 3, and 5 minute hands. One of the embodiments uses a combination of elements for each hour hand to provide a better shaped hand with a greater area. The invention apparatus turns the hour and minute elements forming a minute hand on in repetitive sequence to provide better perceptual association of the elements as a combination and to add visual appeal. The apparatus minimizes the number of pinouts required from the integrated circuit to the displays by using a novel phase and time multiplexing system which allows the same set of common electrodes to serve for both the hour and minute elements and turns on two hour elements by energizing two combinations of electrodes of the same set.

22 Claims, 14 Drawing Figures

HR
SHIFTER
MIN
SEC
F.D.
T.O.
TIMING SIGNALS
COMMON ELECTRODE DRIVE
PHASE LOGIC
HR SET ELECTRODE DRIVE
MIN SET ELECTRODE DRIVE
P.S
+X
-X
TO 17
TO 18

F.D.
T.O.

T.O.
F.D.
SEC.
MIN
5M
HR.
COMMON ELECTRODE DRIVE
1 OF 5 DECODER
1 OF 5 DECODER
OR GATE SET
DRIVERS
Sd
MR
Mg
Hg
MP
Mo
MN
00
01
02
12

ANALOG DISPLAYS FOR ELECTRONIC TIMEPIECES

BACKGROUND OF THE INVENTION

This invention relates generally to time displays for electronic timepieces and particularly to electro-optical displays showing the time in analog or conventional type form.

Mechanical watches and clocks have long used hour and minute hands to show the time, and nearly everyone is intimately familar with such displays. The hour and minute hands not only show the time but also provide the user with a graphic picture of how long it is until some future even time. Most electronic watches presently on the market have decimal digit read outs which show the time precisely in numbers. The user needs only to read the number to "tell" the time to himself or someone else; but he has to make an arithmetical calculation to determine how much time may elapse before he has to take some action, such as leaving for work or keeping an appointment.

As the users of watches want to know how long to some future event much more often than they want simply to "tell" the time, a conventional display is generally more convenient than a decimal digit readout. To meet this need, several inventors have tried to provide displays for electronic watches which approach the conventional. Some have developed very low power electric motors to move a pair of hands mechanically. Others have used loops of optical display elements to designate angular positions for hours and minutes. Still others have used optical display elements shaped to represent hands and have flashed other optical elements to indicate intermediate times by a time code. Specific examples of the prior art follow.

In U.S. Pat. No. 3,540,209, Keeler and Zatsky show several pseudo-conventional displays using liquid crystal or ferroelectric elements to produce radial line segments for the hour, minute, and second positions. In one embodiment, one set of elements is used as an hour hand to show hour positions and as part of a minute hand showing minute positions. The patent also discusses using the display element characteristics in combination with two level gating.

In U.S. Pat. No. 3,754,392, Daniels uses a ring of 60 light emitting diodes, or LEDs, to display minute and second positions and an inner ring of 12 LEDs to show the hour positions. Daniels applies the hour, minute, and second information to a single decoder in repetitive sequences to energize the appropriate LEDs in short duty cycles.

In apparatus disclosed in U.S. Pat. No. 3,969,887, Fukumoto uses LCDs to show the hour position on one of twelve inner elements and the minute position by cumulatively turning on elements in an outer ring of 60. The minute indication is then a series of elements from the 12 o'clock position to the minute position. Fukumoto uses various front and back conductive segment patterns in combination to minimize the number of connections necessary from the display drivers. Fukumoto connects electrodes together in sets without crossovers by means of meandering leads.

In U.S. Pat. No. 3,823,547, Feldman shows 12 hour elements in the shape of hour hands and 12 elements partially encasing the hour elements so that the combinations appear as minute hands. The 12 hour and minute hand positions show the time within 5 minutes and additional interpolation elements are used to indicate each minute.

In U.S. Pat. No. 3,844,105, Kashio uses two rings of 60 elongated liquid crystal elements to show 60 hour and 60 minute positions. A turned-on element in the inner ring shows the hour position while turned-on elements at the same position in the inner and outer rings show the minute position.

In U.S. Pat. Nos. 3,919,835 and 3,992,875, Kashio uses rings of 12 and 60 elements to show 12 hour positions and 60 minute positions. Electrodes of hour and minute elements are connected together in groups to reduce the connections required to the integrated circuit.

U.S. Pat. No. 3,955,354 to Kiley and Schweitzer utilizes 60 elements to show hour, minute and second positions. The element for the hour position is held on steadily while that for the minute position flashes once per second.

U.S. Pat. No. 3,922,847 to Culley and Kehren incorporates rings of 12 and 60 LEDs to show 12 hour and 60 minute positions. The LED electrodes are connected to groups to minimize the number of pinouts required from the integrated circuit.

U.S. Pat. No. 3,968,639 to Berets et al features 12 elongated elements for showing hour positions and a continuous circumferential band for showing minute positions. The voltage applied to the band is increased to turn on successively longer portions from the 12 o'clock position until, by the end of the hour, the whole band is turned on. The band is then erased for the start of the next hour.

U.S. Pat. No. 3,958,409 to Mamber discloses two sets of 12 LEDs to show the hour and five minute positions with extra LEDs flashing to indicate the number of minutes past the five minute position.

U.S. Pat. No. 3,908,355 to Wiesner discloses conductive elements for hour and minute hands on two different plates in an effort to simulate the passage of one hand over the other.

Two prior art references, Keeler and Zatsky and Kashio, show 60 hour elements and 60 minute elements with an hour and minute element used in combination to represent the minute band. The width available for each of the 60 elements decreases with extension inward from the outer circumference, with the result that the elements must be either very short or very narrow. If too short, they are not effective as hands; if too narrow, they cannot be clearly distinguished and are not effective at all.

Feldman of reference shows 12 hour elements and 12 minute elements with an hour and minute element used in combination for a minute hand. Since the 12 minute hand positions can show the time only to the nearest five minutes, Feldman uses other elements to show individual minutes. Auxiliary elements to show minutes represents a major departure from conventional time displays.

SUMMARY OF THE INVENTION

This invention provides electronic watches and the like with time displays which use hour and minute hands to show the time analogically. The user of the invention displays can see at a glance how long it is to a future event of concern instead of having to make a mental calculation as would be necessary with the decimal digit displays used on most present electronic watches. The invention displays have a further advantage over decimal digit displays in that hour and minute hands are traditionally familiar to the majority of potential users.

The invention displays can be constructed for watches of almost any shape and can have any of a wide variety of hand shapes and styles as well as a variety of other features. Watch designers can thus produce artistic designs for many different models using the invention displays and thereby provide electronic watches with the appeal of conventional watches as items of personal jewelry. The design flexibility afforded by the invention displays offers the electronic watch an escape from the monotony of appearence imposed by the uniformity of decimal digit displays.

The face size practical for an electronic watch imposes severe restrictions on hour hand displays. 60 non-overlapping elements to individually present 60 hour hand positions would be too small for adequate visibility and would either be impossible to build or be very expensive. The present invention provides displays which can adequately show the time with a fewer number of hour elements and hour hand positions. The invention also uses elements in combination to form each hour hand with a better shape and greater area than is possible for single non-overlapping elements.

The invention uses the hour elements in combination with the minute elements to form minute hands which provide the user with a stronger angular sense of position than if afforded by isolated minute elements. The invention apparatus turns the hour and minute elements on in repetitive sequence to associate them together in time for improved perception of the two as a combination. This is especially important when the two are spacially separated or are irregular in shape as necessary to form more than one minute hand with the same hour element. The repetitive sequencing also provides a pleasing animation and cooperates with other multiplexing means to reduce pinouts as will later be explained. The invention also uses repetitive sequencing to show more minute positions than minute elements for minute hand positions. Periodic turning on of minute elements adjacent to the minute hand position shown indicates a minute before or after the minute hand position.

The number of pinouts required between the integrated circuit and the display is an important factor in the cost of building. The invention minimizes the number of pinouts required by providing a novel multiplexing system which permits the hour and minute elements to share the same set of common electrodes. The invention apparatus selects non-interfering phase combinations to energize combinations of a set of electrodes to turn on hour elements for the hour and minute hand positions at the same time. The time sequencing of hour and minute elements for the minute hand enables phase selection to also avoid any interaction between the hour and minute positions for the minute elements using the same common electrodes. Where the hour hand and the hour hand section of the minute hand are formed of a combination of elements, the invention apparatus alternates the hour and minute hand presentations in time to avoid conflict in using the same set of electrodes.

The repetitive sequential animation of hour and minute elements for minute presentations perceptually ties the elements together by time association so that small elements can provide effective presentations with minimum area for minimum cost.

The invention displays can, of course, present month and day and other data in place of hours and minutes for multi-function readouts in response to appropriate controls.

BRIEF DESCRIPTION OF THE DRAWINGS

FIG. 2*d* is a schematic diagram of one embodiment of one of the circuit blocks of FIG. 2*a*.

DESCRIPTION OF THE PREFERRED EMBODIMENTS

Figures 1A, 1B, 1D, 2B, 2C, 3B:
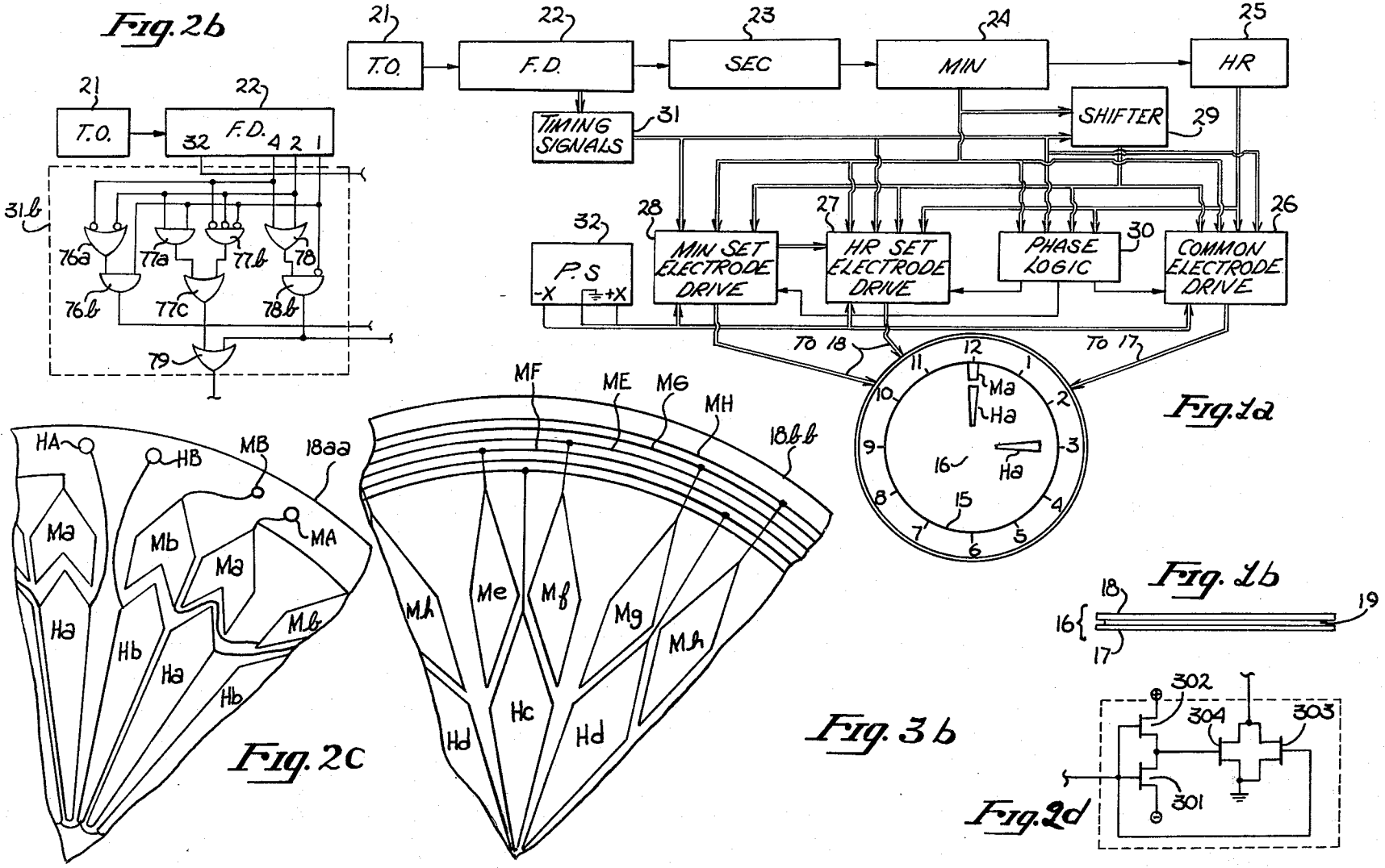
FIG. 1*a* is a general block diagram showing the major components and a plan view of a display of a general embodiment of the invention.
FIG. 1*b* is a cross-sectional view of the display of FIG. 1*a*.
FIG. 2*b* is a partial block and partial logic diagram of a modification to the apparatus of FIG. 2*a*.
FIG. 2*c* is a plan view of a fragmentary section of a display electrode plate having electrodes with different shapes to be used with the apparatus of FIG. 2*a*.
FIG. 3*b* is a plan view of a fragmentary section of a display electrode plate with a different electrode pattern for a modification to the apparatus of FIG. 3*a*.

The watch dial 15 of FIG. 1*a* has conventional hour and minute markings to provide a time position reference for hour and minute hands. Liquid crystal display 16 occupies the watch face area inside dial 15 and presents an hour hand and a minute hand to show the time similarly to a conventional watch. The presentation in FIG. 1*a* shows the time to be 3 o'clock: the combination of hour and minute elements Ha and Ma respectively, visible at the 12 o'clock position, represents the minute hand, while the hour element Ha visible at the 3 o'clock position represents the hour hand. Dial 15 and display 16 can be oval, diamond, or some other shape in addition to the round shape shown. Hour and minute elements Ha and Ma respectively can also be of various shapes to satisfy existing designs, as will later be explained.

Liquid crystal displays are well known to those skilled in the art. The aforementioned U.S. Pat. No. 3,969,887 to Fukumoto, for example, discusses liquid crystal displays generally and discloses a liquid crystal display of a type similar to that which might be used for display 16. Display 16 consists of common electrode plate 17 hour and minute electrode plate 18, and liquid crystal material 19 with seal, as shown in cross section in FIG. 1*b*. Plates 17 and 18 sandwich material 19 so that the potential differences between electrodes on plate 17 and electrodes on plate 18 produce voltage gradients across coextensive areas of material 19. When the voltage gradient across a specific area of material 19 exceeds a threshold value, the material 19 in that area changes state. The optical character of material 19 in the state for gradients below the threshold is different from its character for the state for gradients above the threshold.

Control of the voltages applied to the electrodes of plates 17 and 18 thus controls the areas of material 19 which are in different states. Upper plate 18 and its electrodes are transparent; so the areas of material 19 in one state stand out on display 16. While the visible or image shaping areas could be the result of either the above or below threshold states, the invention embodiments assume use of displays in which the visible areas result from the above threshold state. Those skilled in the art will recognize that the apparatus could be modified to make use of other types of displays. The outputs of common electrode drive 26 are applied to the electrodes of plate 17 and the outputs of hour set electrode drive 27 and minute set electrode drive 28 are applied to the electrodes of plate 18 to control display 16. The physical connections between drives 26, 27, and 28 and plates 17 and 18 can be made by structures and arrangements known to the prior art, such as those shown in aforementioned U.S. Pat. No. 3,969,887.

The electronic circuitry represented by blocks 21 through 31 will, of course, be implemented on an integrated circuit chip which can fit inside the case of a watch back of display 16. Timing oscillator 21 provides the timing reference signal and may include a quartz crystal for extreme stability, as is common in present electronic watches. Frequency divider 22 divides the output of timing oscillator 21 down to a one hertz signal to step seconds register 23. Frequency divider 23 also provides other outputs to timing signals 31 for uses to be described later. Seconds register 23 divides the one hertz signal down to a one per minute signal to step minute register 24. Minute register 24 in turn produces a one per hour signal to step hour register 25. Circuits represented by blocks 21 through 25 can therefore be circuits such as are used in present electronic watches.

The binary digit outputs of hour register 25 and of minute register 24 through shifter 29 go to common electrode drive 26 to determine which of the electrodes on plate 17 will be energized. Drive 26 responds by energizing an electrode corresponding to the hour position held in register 25 and another electrode corresponding to the five minute position held by shifter 29. The five minute position held by shifter 29 will be the same as that held in register 24, except during the intervals that shifter 29 operates to shift the position, as will be explained later. Phase logic 30 provides an input to drive 26 which determines whether drive 26 applies the same phase voltage to the common electrode for the five minute position as it does to the common electrode for the hour position. The phase will be different unless the hour and five minute positions require the same electrode on plate 17, or the same set of electrodes on plate 18, as will later be explained.

Hour set electrode drive 27 receives inputs from hour register 25 and from minute register 24 both directly and through shifter 29. Drive 27 then energizes one set of hour electrodes on plate 18 for the hour position and another set for the minute position. An input from phase logic 30 determines whether the two sets receive the same or different phase voltage excitation. The phase must be the same when the hour and minute positions use the same set of hour electrodes or the same common electrodes. Phase logic 30 receives inputs from registers 24 and 25 and shifter 29 to determine when these conditions obtain. The phase applied to the set of hour electrodes on plate 18 for the hour position will always be different from that applied to the common electrode on plate 17 for the hour position. Similarly, the phase will be different for the hour set and common electrodes of plates 18 and 17 respectively for the minute position.

The difference in phase between the hour electrode set and the common electrode for either the hour or minute positions results in the change in state in material 19 of the area between the common electrode and the electrode of the hour set coextensive with the common electrode. Where the sets and the common electrodes are different for hour and minute positions, the phase for the hour set for one is the same as the phase for the common electrode of the other; thus there is no interaction between the set of one and the common electrode of the other. Hour elements corresponding in shape to the hour electrodes will thus turn on for the hour position and for the minute position. In another mode of operation, drives 26 and 27 use inputs from timing signals 31 to respond alternately to the hour and minute position information. As a result, the hour hand and the hour section for the minute hand are presented alternately. As the two hour elements are not turned on at the same time, the same phases can be used for both the hour and minute positions and phase logic 30 is not required to select the phase for the minute position.

Minute set electrode drive 28 receives inputs from minute register 24 both directly and through shifter 29. Drive 28 responds to the inputs by energizing a set of minute electrodes on plate 18 to turn on minute elements for the minute position. Drive 28, like drives 26 and 27, receives an input from phase logic 30 to determine the phase of the voltage applied to the selected minute electrode set. The voltage must be opposite in phase to that applied to the common electrode on plate 17 for the minute position. Plate 17 may have a set of common electrodes for the hour elements and a set of common electrodes for the minute elements or only a single set for both. In the latter case, it is necessary to alternate the turning on of the hour and minute elements for the minute hand in order to avoid a possible turning on of a minute element at the hour position also, when hour and minute positions require the same hour electrode set and different common electrodes.

The alternate turning on of the hour and minute elements of the minute hand with possibly a slight overlap produces an animated arrow effect. Such animation provides visual appeal and also perceptually associates the hour and minute elements in time to strengthen the sense of their being a combination. Phase logic 30 maintains the right phases for the excitation voltages, both while the hour element of the minute hand is being excited and while the minute element is being excited.

When plate 17 has a set of electrodes for the hour elements and another set of electrodes for the minute elements, the hour element for the minute position can stay on along with the hour element for the hour position. The common electrodes for the minute set will be energized in response to the minute position only. The hour and minute elements for the minute hand can then be held on continuously, if desired, or sequentially energized with a long over-lapping interval.

In some models, display 16 has fewer than 60 minute elements. The corresponding fewer than 60 minute positions are shown directly as in the other models by turning on an hour element and a minute element to represent a minute hand at that position. The other minute positions are shown by turning on the preceding or following adjacent minute element to indicate minute positions respectively one minute before or one minute after the minute hand position presented.

Where plate 17 has only one set of common electrodes for both the hour and minute elements, the adjacent element can be turned on in turn following each of the hour and minute element sequences for the minute hand presentations. Where plate 17 has a set of common electrodes for the hour elements and a set for the minute elements, the adjacent element can be held on steadily with the minute hand presentation except when its position coincides with the hour position. Turning the adjacent minute element on periodically while holding the minute element for the minute hand on steadily will distinguish the positions in the latter circumstance.

Shifter 29 receives inputs from minute register 24 and timing signals 31 to produce the information for energizing the adjacent minute element. The output of shifter 29 goes to drives 26, 27, and 28 and to phase logic 30. Where the adjacent minute element is to be turned on periodically, shifter 29 can present the adjacent position periodically and the minute position the rest of the time. Drives 26, 27, 28 and phase logic 30 then need response only to the output of shifter 29. Where the adjacent minute element is to be turned on at the same time, drives 26, 27, and 28 and phase logic 30 must respond to the output of minute register 24 as well as to the output of shifter 29 and shifter 29 must hold the adjacent position.

Timing signals 31 provides outputs to drives 26, 27, and 28 and to shifter 29 and phase logic 30. Timing signals 31 develops the signals required for alternating or sequencing the energizing of electrodes and the signals required for the different phases from the outputs of frequency divider 22. Phase logic 30 responds to the various position information inputs from registers 24 and 25 and shifter 29, and to the timing inputs from timing signals 31, to control the phases applied by drives 26, 27, and 28 for the desired results. Power supply 32 provides equal positive and negative voltages from a reference ground output to the output drivers of drivers 26, 27, and 28 when they are to be used to energize more than one combination of electrodes to turn on two elements of a set at the same time. For those modes of operation which do not have two elements of a set turned on at the same time, power supply 32 need provide a single polarity output only.

Power supply 32 will include batteries which may power some of the circuits directly, and one or two up converters to produce voltages satisfactory for the thresholds of the liquid crystal material 19 used in display 16. All or nearly all of the electronic circuitry will be implemented on an integrated circuit chip using an appropriate technology such as CMOS. The completed watch will have a case holding dial 15, display 16, a battery, an integrated circuit, and any miscellaneous circuitry or apparatus such as a quartz crystal. The auxiliary apparatus may include printed wiring and conductive rubber elements to make connections between the integrated circuit output stages and the electrodes on plates 17 and 18.

Figure 2A:
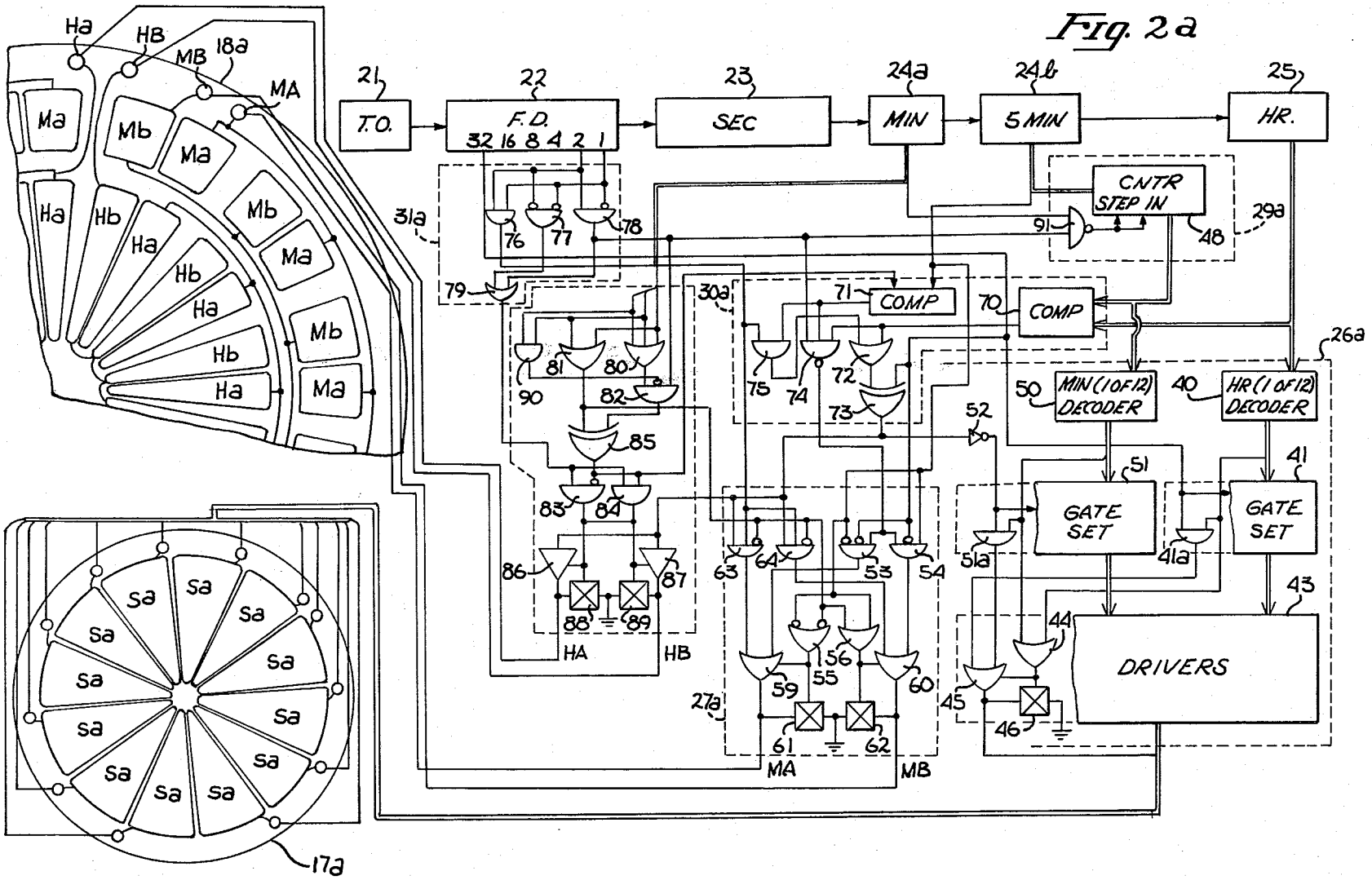
FIG. 2*a* is a partial block and partial logic diagram and plan views of fragmentary sections of the display electrode plates of an embodiment of the invention.

The liquid crystal display to be used with the apparatus of FIG. 2*a* has a common electrode plate 17 with 12 common electrodes S, and another electrode plate 18 with 24 hour element electrodes Ha and Hb, and 24 minute element electroddes Ma and Mb. The plates 17 and 18 to together sandwiching a liquid crystal material in a cavity between them to form the working display in a manner well known to those skilled in the art. At least the upper plate and its electrodes must be transparent. A potential difference exceeding a threshold value between a common electrode on plate 17 and an opposite electrode on plate 18, which falls within the area of the common electrode, causes the liquid crystal material in between to change stage and the area of the opposite electrode to become visible.

The 12 common electrodes S on plae 17 are each pie pieced in shape and subtend angles of approximately 30 degrees starting approximately 6 degrees before the center of each hour marker. The 24 hour element electrodes Ha and Hb on plate 18 divide into HA and HB sets of 12 electrodes Ha and 12 electrodes Hb respectively. The HA set of electrodes Ha are centered on the hour positions and the HB set of electrodes Hb are centered on the positions 3/5ths of the way to the next hour position, or, in other words, at the three minutes past the five minute positions. The minute element electrodes Ma and Mb on plate 18 similarly form MA and MB sets respectively. Electrodes Ma align with electrodes Ha at the hour or five minute positions and electrodes Mb with electrodes Hb at the three minutes past the five minute positions.

The FIG. 2*a* apparatus shows the hour position by applying a phase one 32 hertz square wave signal to the appropriate one of common electrode S and a phase two 32 hertz square wave signal to the appropriate hour element set HA or HB of electrodes Ha or Hb respectively. The phase one and phase two signals are 180 degrees apart; so the voltage between the energized one of electrodes S and the opposite energized one of electrodes Ha or Hb exceeds the threshold value. The liquid crystal material in between changes state and the area of the energized one of electrodes Hs or Hb becomes visible. The electrodes Ha and Hb are large enough to be easily seen; moreover, designers can shape them in various ways to represent hour hands as shown, for example, in FIG. 2*c*.

The display of FIG. 2*a* thus shows the hour position by a visible hour hand in much the same way that a conventional mechanical watch does. The difference is that the FIG. 2 display has only two positions for each hour interval instead of the continuum of positions of a mechanical watch. The displayed hour hand remains on the hour position from 0 to 40 minutes past the hour and on the 3/5ths position from 40 to 60 minutes past the hour. The two positions avoid a possible error by the user as to the intended hour as the minutes approach the next hour. It is believed that the 24 positions present the hour as effectively as the continuum of positions of a mechanical watch since the user always refers to the minute hand position to determine the fractions of an hour.

The FIG. 2*a* display shows 24 of the 60 minute positions by having the area of an hour electrode Ha or Hb and the area of a minute electrode Ma or Mb at the minute position become visible in turn each second. The electrodes Ha, Hb, and Mb are shaped so that the combination effectively represents a minute hand. The hour element turns on first and the minute element turns on as the hour element turns off. The sequence gives a darting arrow effect which supplements the shapes in perceptually tying the hour and minute elements together. The animated arrow formed by the repetitive turning on and off of the hour element and minute elements in turn simulates the minute hand of a conventional mechanical watch.

The turning on of the hour element for the minute hand at the same time that an hour element is being held visible for the hour hand requires selection of the proper combination of phases to energize the appropriate electrodes. If the hour and minute positions require different common electrodes and different sets of electrodes Ha and Hb, the apparatus applies phase two to the common electrode S for the minute position and phase one to the set HA or HB for the minute position. The energized common and hour element electrode combinations for hours and for minutes are out of phase while those combinations for minutes with hours or vice versa are in phase. Only those out of phase exceed the threshold and produce a turn on.

If the hour and minute positions require the same common electrode S, the apparatus applies phase one to it and phase two to both the hour element set for the hour position and the hour element set for the minute position. If the hour element set for the hour position is the same as that for the minute position, only phase two can be applied to the set. Phase one will then be applied to the common electrode S for the minute position as well as to the common electrode S for the hour position. The apparatus thus handles all combinations and makes visible an hour element for the hour position and an hour element for the minute position at the same time, unless the two are the same.

The apparatus turns on the hour element for the minute position for approximately ¼ second every second, and turns on the minute element for the minute position for approximately ¼ second following the hour element turn on. If hour and minute positions require different common electrodes S, the apparatus applies phase two to the electrode S for the minute position during the intervals for turning on minute elements. Application of phase one to the appropriate minute set MA or MB then turns on the proper minute element. The same phase is applied to the electrode Ma or Mb opposite the common electrode S for the hour position and so no turn on results. If the hour and minute positions require the same common electrode S, then the apparatus applies phase two to the appropriate set MA or MB to turn on the right minute element.

To show the other 36 minute positions, the apparatus also turns on a second minute element each second for approximately ¼ second following the turn on of the first minute element. The second minute element is adjacent to the first and indicates that the minute position is one minute before or one minute after the first minute element position, depending on the relative position of the second minute element with respect to the first. Presentation of the second minute element, when needed, thus fills in part of the time gap between successive hour and minute element turn ons for the minute hand. If the second minute element position aligns with the hour position, the hour hand element may or may not be turned off while the second minute element is on as will later be explained.

Referring now to the circuit portion of FIG. 2*a*: timing oscillator 21, frequency divider 22, seconds register 23 and hour register 25 are the same as in FIG. 1*a*. Minute register 24 of FIG. 1*a* consists of the cascaded combination of minute register **24*a* and five minute register 24*b*** in FIG. 2*a*. Minute register **24*a* has five different states and provides a signal out every five minutes to step five minute register 24*b***. All of the other blocks of FIG. 1 have specific embodiments shown in some detail in FIG. 2 and these will be discussed next.

Common electrode drive **26*a*** of FIG. 2*a* consists of one of 12 hour decoder 40, gate set 41, drives 43, one of 12 minute decoder 50 and gate set 51. Hour decoder 40 receives the output of hour register 25 and produces a control voltage on the output corresponding to the hour position. Gate set 41 consists of 12 AND gates all the same as gate **41*a* shown in the cutaway section. Drivers 43 consist of 12 sets of an OR gate 44, a tri-state OR gate 45, and a two-way conduction gate 46 such as the set shown in the cutaway portion. Minute decoder 50 is the same as hour decoder 40 except that it receives its input from counter 48 of shifter 29*a* and produces a control voltage on the output corresponding to the five minute position held in counter 48. Gate set 51 is the same as gate set 41**.

The control voltage output of decoder 40 enables the associated AND gate **41*a* of gate set 41 to pass a 32 hertz square wave signal which it receives from frequency divider 22 via timing signals 31*a*. The control voltage also goes through the associated OR gate 44 to enable the associated tri-state OR gate 45 and turn off the associated two-way conduction gate 46. The 32 hertz signal passed by the associated AND gate 41*a* goes to the associated tri-state OR gate 45. The associated OR gate 45** output goes to the common electrode S corresponding to the hour position and energizes it with the 32 hertz phase one signal.

Similarly, the control voltage on the output of decoder 50 corresponding to the five minute position held in counter 48 enables its associated AND gate **51*a* of gate set 51 to pass a 32 hertz square wave signal from phase logic 30*a* to its associated tri-state OR gate 45. The decoder 50 control voltage output also goes to its associated OR gate 44 to turn off the associated gate 46 and enable the associated gate 45. The gate 45 output then energizes the common segment electrode S corresponding to the five minute position in counter 48 with a 32 hertz square wave whose phase depends on conditions determined by phase logic 30*a***.

Common electrodes S corresponding to the hour position in hours register 25 and to the five minute position in counter 48 will thus be energized by outputs from their respective OR gates 45. If the hour and five minute positions happen to be the same, phase logic insures that the output from gate set 51 will be the same as that from gate set 41, as will later be explained; so the shared electrode S will have only phase one applied. The two-way conduction gates 46 for the common electrodes S not corresponding to the hour or five minute positions will be on and will hold those electrodes S substantially at ground potential. The two-way conduction gates 46 corresponding to either the hour or five minute position will be off and present substantially an open circuit and little loading on the output. FIG. 2*d* shows a possible circuit for gate 46.

Hour set electrode drive 27*a* consists of AND gates 53, 54, 63, and 64, OR gates 55 and 56, tri-state OR gates 59 and 60 and two-way conduction gates 61 and 62. Gates 55, 59, and 61 and gates 56, 60, and 62 are the same as each of the sets of gates 44, 45, and 46 and function to energize hour element sets HA and HB respectively. Gates 53 and 54 receive the highest digit output of five minute counter 24*b*, which will be a "1" when the time is between 40 and 60 minutes past the hour. Gate 53 receives the register 24*b* output on an inverted input, as indicated by the small circle, and so is enabled during the interval, when the time is between 0 and 40 minutes past. Gate 54 receives the output on a direct input and so is enabled during the intervals when the time is between 40 and 60 minutes past. Gates 53 and 54 receive the 32 hertz signal from frequency divider 22 on inverted inputs; so their 32 hertz outputs are opposite in phase to the phase of the outputs from gate set 41.

The highest digit output from register 24*b* also goes to an inverted input of OR gate 55 and to a direct input of gate 56. The outputs of gates 53 and 54 go respectively to gates 59 and 60. The electrodes Ha of set HA will thus have a phase two 32 hertz signal applied via gates 53 and 59 while the time is between 0 and 40 minutes past the hour. The electrodes Hb of set HB will similarly have the phase two 32 hertz signal applied via gates 54 and 60 while the time is between 40 and 60 minutes past the hour. It will be recognized that different intervals could be chosen for the two positions of the hour hand by using decoding circuitry to produce an output to substitute for the highest digit output of register 24*b*.

Gates 63 and 64 operate in the same way as gates 53 and 54 to energize the electrodes Ha or Hb of the HA or HB sets for the minute position. A control output from or gate 81 in minute set electrode drive 28*a* derived from the output of minute register 24*a* goes to inverted inputs of gates 63 and 55 and to direct inputs of gates 64 and 56. Gates 69 and 64 receive the 32 hertz sigal from exclusive or gate 73 or phase logic 30*a* which also goes through inverter 52 to gate set 51. The phase of the 32 hertz signal from gates 63 and 64 will thus be opposite to that from gate set 51 to turn on the hour element corresponding to the minute position. When gate 53 or 54 calls for energizing the same set HA or HB as gate 63 or 64 respectively, phase logic 30*a* will produce a phase two output to gates 63 and 64 to avoid a conflict of signals.

Phase logic 30*a* consists of comparators 70 and 71, OR gate 72, Exclusive OR gate 73, NAND gate 74, and AND gate 75. Comparator 70 receives the outputs of hour register 25 and counter 48 and produces a "1" output when the two are the same. Comparator 71 receives the highest digit output of five minute register 24*b* and the output from exclusive or gate 85 of minute set electrode drive 28*a* which depends on the contents of minute register 24*a*. Comparator 71 also produces a "1" output when its two inputs are the same. Exclusive OR gate 73 responds to the outputs of comparators 70 and 71, as received through gate 72 and through gates 72 and 75 in combination repetitively, to control the phase of the 32 hertz signal supplied to gate set 51, gates 63 and 64 and tri-state amplifiers 86 and 87 of drive 28*a*. NAND gate 74 produces an output to inhibit gates 53 and 54 to turn off the hour hand during the second minute element interval when the second minute element is at the hour position.

The 32 hertz output of Exclusive OR gate 73 will be phase one when neither of comparators 70 or 71 has a "1" output. Gates 63 and 64 and drive 28*a* receive the gate 73 output directly while gate set 51 receives it through inverter 52. The common electrode S for the minute position will then receive phase two while sets HA or HB and sets MA or MB will receive phase one. A "1" from comparator 70 when register 25 and counter 48 hold the same number reverses the phases. The output of gate set 51 to the shared common electrode S will thus be phase one; so it will not conflict with the output from gate set 41. Gate 75 receives an enabling input from timing signals 31*a* during the intervals the hour element is to be turned on for the minute position. Gate 75 then passes a "1" output during the intervals to gate 72 when comparator 71 has a "1" output. The resulting phase reversal prevents a conflict between the signal from gate 63 or 64 with that from gate 53 or 54 when the minute and hour positions require the same set HA or HB.

NAND gate 74 receives inputs from both comparator 70 and comparator 71; thus it is enabled to produce an inhibiting input to gates 53 and 54 when minute and hour positions are the same. NAND gate 74 also receives an input from timing signals 31*a* and an input from drive 28*a;* so it can produce an output to inhibit gates 53 and 54 only during the intervals when a second minute element is being turned on. The action of gate 74 turns off the hour hand display while the second minute element is turned on in the same location. If this action is not desired, gate 74 may be omitted.

Timing signals 31*a* consists of AND gates 76, 77, and 78 and OR gate 79. Gate 76 produces a "1" output during the first $\frac{1}{4}$ second of each second, gate 77 a "1" output during the second $\frac{1}{4}$ second, and gate 78 a "1" output during the third $\frac{1}{4}$ second. OR gate 79 receives the outputs of gates 77 and 78 and so produces an output during the second and third $\frac{1}{4}$ seconds of each second. The first $\frac{1}{4}$ second output from gate 76 goes to gates 63 and 64 to enable energizing set HA or HB for the minute position. The gate 76 output also goes to gate 75 to enable changing the phase of the 32 hertz signal from gate 73, if comparator 71 has a "1" output. The output of gate 78 during the third $\frac{1}{4}$ second intervals goes to gate 74 to enable turning off the hour hand for the second minute element interval, to nand gate 91 of shifter 29*a*, and to and gate 82 of drive 28*a*. The output of OR gate 79 during the second and third $\frac{1}{4}$ second intervals goes to AND gates 83 and 84 of drive 28*a*. The functions of drive 28*a* and shifter 29*a* will be described next.

Minute set electrode drive 28*a* consists of OR gates 80 and 81, AND gates 82, 83, 84, and 90, Exclusive OR gate 85, tri-state amplifiers 86 and 87, and two-way conduction gates 88 and 89. The apparatus of electrode drive 28*a* energizes the proper minute electrode set MA or MB during the second and third $\frac{1}{4}$ second intervals and provides minute control inputs to gates 63 and 64 of hour electrode drive 27*a* and to comparator 71 of phase logic 30*a*. The input to drive 27*a* controls gates 63 and 64 to energize the appropriate one of hour electrode set HA or HB for the minute position during the first $\frac{1}{4}$ second intervals, as previously described. The input to phase logic 30*a* goes to comparator 71 to determine when hour and minute positions require the same set HA or HB.

OR gate 80 receives the digit outputs from minute register 24*a* and so produces a "1" output when the binary number in register 24*a* represents 1, 2, 3, or 4. AND gate 90 receives the two lowest order digits from register 24*a* and so produces a "1" when the binary number held represents 3. AND gate 82 receives the output of gate 80 directly and the output of gate 90 on an inverting input. Gate 82 is thus enabled when register 24*a* holds a 1, 2, or 4, to respond to the output of gate 78 during the third ¼ second intervals. OR gate 81 receives the two highest order digit outputs from register 24*a* and so produces a "1" output when the binary number held represents 2, 3, or 4. The gate 81 output goes to gates 63 and 64 to enable energizing set HA or HB for the minute position during the first ¼ second interval and to gate 85.

Exclusive OR gate 85 receives the outputs of gates 81 and 82 and produces a "1" when they are different and a "0" when they are the same. The gate 82 output will change to "1" during the third ¼ second intervals when register 24*a* holds 1, 2, or 4, and so the gate 85 output will also change from "1" to "0" or from "0" to "1", depending on whether the gate 81 output is a "1" or a "0". These changes of the gate 85 output assist in the turning on of the adjacent minute elements, as will later be explained. With the output of the gate 82 always "0" during the first and second ¼ second intervals, the gate 85 output will be the same as that of gate 81. Gate 85 will thus provide a "0" output during the first and second ¼ second intervals when register 24*a* holds 0 or 1 and a "1" when register 24*a* holds 2, 3, or 4.

Gates 83 and 84 receive enabling inputs during the second and third ¼ second intervals by the output of gate 79. If the output of gate 85 is a "0", gate 83 then produces a "1" output to turn off gate 88 and enable tri-state amplifier 86 to pass the 32 hertz signal and energize the MA set. If the output of gate 85 is a "1", then gate 84 produces a "1" to turn off gate 89 and enable amplifier 87 to pass the 32 hertz signal and energize the MB set. It will be recognized that the combination of amplifier 86 and gate 88 and the combination of amplifier 87 and gate 89 function in the same way in response to the outputs of gates 83 and 84 respectively as the combination of gates 45 and 46 do in response to the output of gates 44.

Gates 83 and 84 are energized by the output of gate 79 during the third ¼ second intervals as well as the second ¼ second intervals. If register 24*a* holds 0 or 3, the outputs of gates 82 and 85 remain the same. The same set MA or MB then remains energized during both the second and third ¼ second intervals. The same minute element is thus turned on for ¼ second each second. It will be recognized that the minute hand position represented corresponds to the actual time held in registers 24*a* and 24*b*. If register 24*a* holds 1, 2, or 4, the time differs from the minute hand position at 0 or 3 and the outputs of gates 82 and 85 will change during the third ¼ second intervals. The change in gate 85 output energizes the other of set MA or MB to turn on a different minute element during the third ¼ second intervals.

If register 24*a* holds 1, hour and minute elements at the five minute position will turn on in response to energizing during the first and second ¼ second intervals respectively. The minute element at the position three minutes past the five minute position will then turn on in response to energizing during the third ¼ second intervals. As this minute element is the adjacent one on the past side, its turning on indicates the time is one minute past the five minute position of the hour and minute element combination. When register 24*a* holds 2, the hour and minute elements at the three minutes past the proper five minute position turn on in response to energizing during the first and second ¼ second intervals respectively and the minute element at the five minute position before on the side turns on due to energizing during the third ¼ second intervals. The adjacent minute element before the hour and minute combination indicates the time is one minute before.

When register 24*a* holds 4, shifter 29*a* operates during each third ¼ second period to also change the five minute position supplied to decoder 50. Shifter 29*a* consists of counter 48 and NAND gate 91. Counter 48 is a programmable type which is set to whatever input it is receiving from register 24*b* when its input gates are enabled. When gate 91 is disabled, its output is a "1" which enables the input gates of counter 48 so that counter 48 holds the same number as is in register 24*b*. The output for highest order digit of register 24*a* goes to gate 91; so gate 91 is enabled while register 24*a* holds 4. The output of gate 91 then goes to "0" with each output from gate 78 during the third ¼ second intervals. The "0" output from gate 91 disables the input gates of counter 48 and steps counter 48 to its next position. Counter 48 remains in the next position until the output of gate 91 again goes to "1" at the end of the third ¼ second interval and again sets counter 48 to the number held in register 24*b*.

With counter 48 in its next position, the electrode S for the next five minute position is energized. The adjacent minute element at the next five minute position is then turned on by the energizing during the third ¼ second intervals. This minute element is the next adjacent to the hour and minute element combination at the three minutes past position and so properly indicates the time is one minute past the combination position.

Other timing patterns for the turn on of the elements showing the minute position are, of course, possible. The hour element of the minute hand can be energized for the full ½ second interval when the minute elements are not being energized simply by providing the one hertz signal to gates 63, 64 and 75 in place of the output from gate 76. The proper timing would also obtain if the two hertz input to gate 76 where simply changed to the positive supply. Another change to allow the hour and minute elements of the minute hand to overlap somewhat and to increase the energizing time for all elements to ⅜ of a second each is shown in FIG. 2*b*. The longer energizing time may be desirable for some liquid crystal materials. Still longer times could, of course, be obtained by increasing the repetition period: 1½ seconds would, for example, allow ½ second energizing time for each.

The FIG. 2*b* modification for ⅜ seconds merely requires the addition of four gates to timing signals 3*b*. Gates 76*a* and 76*b* in combination replace gate 76 for the hour element energizing interval. The output of gate 76*b* goes in place of that of gate 76 of timing signals 31*b* in FIG. 2*a*. Gates 77*a*, 77*b*, and 77*c* similarly replace gate 77 to provide an output for the minute element of the minute hand; and gates 78*a* and 78*b* replace gate 78 to provide an output for the adjacent minute element. The outputs of gates 77*c* and 78*b* go to gate 79 and the output of gate 78*b* goes to the same locations as did the output of gate 78 in the FIG. 2*a* apparatus. The output of gate 76*b* is positive for the first ⅜ of every second, the output of gate 78*b* is positive for the last ⅜ of every second, and the output of gate 77c is positive for $\frac{3}{8}$ of a second starting after the first $\frac{1}{4}$ second.

It will be noted that the gate 77c and 76b outputs overlap by $\frac{1}{8}$ of a second. The hour and minute elements of the minute hand will thus be on for a short time together. It is believed that this condition is acceptable and may even be desirable. The minute element at the hour position will also be energized for the overlapping $\frac{1}{8}$ of a second when the hour and minute positions require the same set, HA or HB. This FIG. 2b modification can thus be used only when energizing for $\frac{1}{8}$ of a second every second is not sufficient to appreciably turn on a minute element.

As previously mentioned, the hour and minute elements can be any of many shapes within the available area. FIG. 2c shows a second of another plate 18aa, usable with the apparatus of FIG. 2a, which has hour electrodes Ha and Hb and minute electrodes Ma and Mb of different shapes. The point given to the hour electrodes Ha and Hb provides a more conventional hour hand representation while the matching shape of the minute electrodes Ma and Mb allows the combination to provide a more conventional minute hand representation. The hour electrodes Ha and the minute electrodes Mb are still interconnected by conductive lines running across the gaps between the hour electrodes Ha and Hb and the minute electrodes Ma and Mb. FIG. 2c is merely intended to demonstrate the obvious point that the available space allows the designer to design any number of artistic shapes, all suitably visible and effective as hands.

FIG. 2d shows a circuit which could be used for the two way conduction gates 46, 61, 62, 88, and 89 of FIG. 2a. The two way conduction gate control input goes to the input of transistors 301 and 302 and to the input of transistor 303. Transistors 301 and 302 are N and P channel MOS transistors as provided by CMOS circuit techniques. Transistors 301 and 302 function as a CMOS inverter with one conducting and the other non-conducting when the input is in one state and a change of input state reversing the conducting state of each. Transistors 303 and 304 are P and N channel transistors respectively connected in parallel between ground and the tri-state output with which the two-way gate is associated. Transistor 304 has its gate connected to the output of the inverter provided by transistors 301 and 302.

When the control input is negative, the P channel transistors 302 and 303 will be turned on, and N channel transistor 301 will be turned off. Transistor 304 is N channel and will also be turned on by the positive output from the inverter to its gate. The parallel combination of transistors 303 and 304 both in the conducting state will then hold the tri-state output substantially at ground potential, the midpoint between the positive and negative supply voltages. When the control input is positive, transistor 301 will be turned on and transistors 302 and 303 turned off. The resulting negative output from the inverter will also turn transistor 304 off. The parallel combination of transistors 303 a and 304 in the off state then offer a very high impedance to the tri-state output.

Figure 3A:
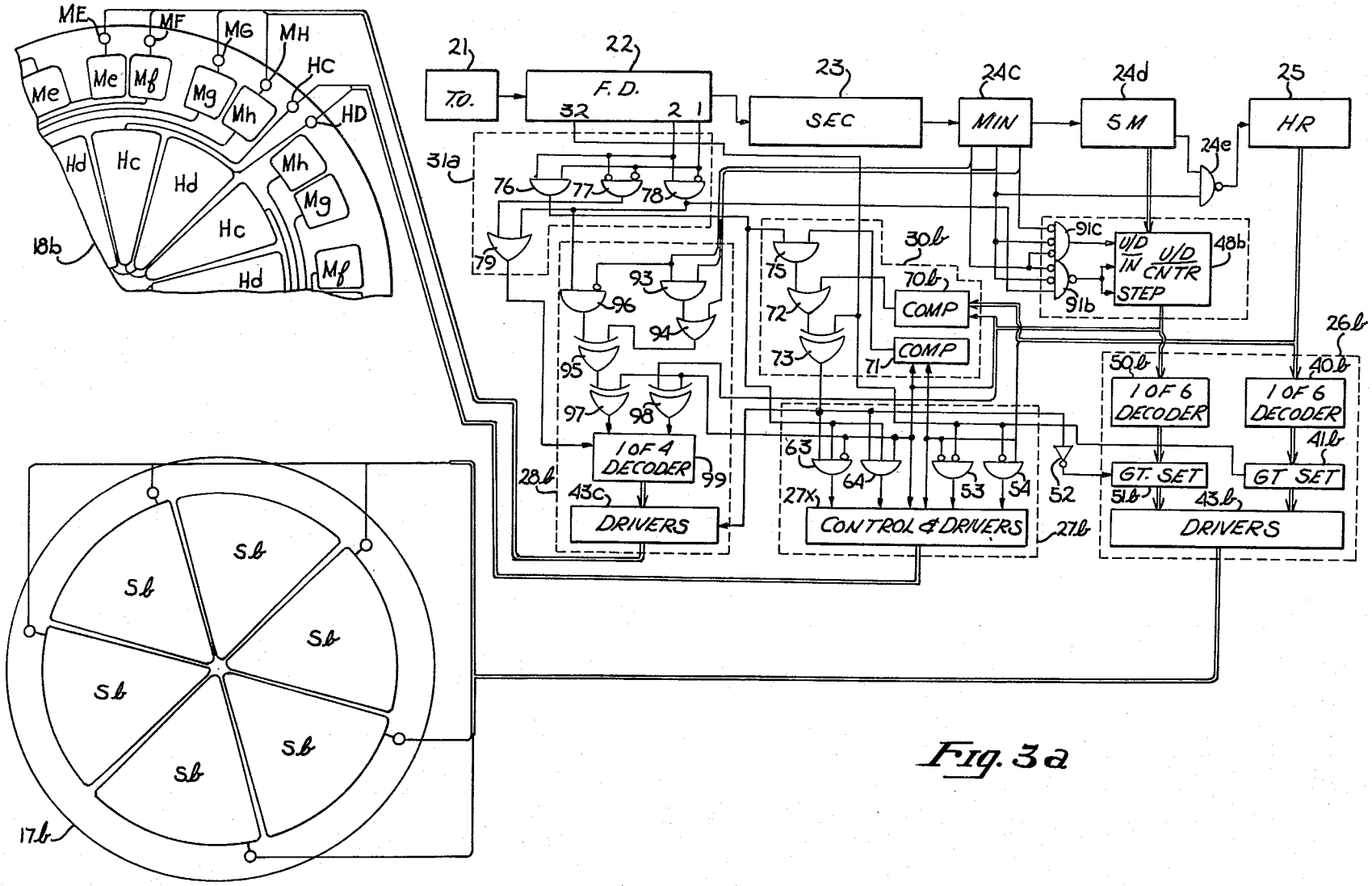
FIG. 3*a* is a partial block and partial logic schematic diagram together with plan views of fragmentary sections of the display of another embodiment of the invention.

The common electrode plate 17b of FIG. 3a has six electrodes Sb, each of which is pie piece in shape and subtends an angle of approximately 60 degrees. Electrodes Sb have their edges approximately 15 degrees from the two hour positions along their outer circumference. The other electrode plate 18b has 12 hour electrodes Hc and Hd and 24 minute electrodes Me, Mf, Mg, and Mh. Electrodes Hc and Hd are pie piece shaped and center on the even and odd hour positions respectively. Minute electrodes Me, Mf, Mg, and Mh are sections of cones approximately 12 degrees wide centering on the one minute before and the one minute after each hour position. The order of electrodes Me, Mf, Mg, and Mh reverses after each sequence with the order Me, Mf, Mg, and Mh running clockwise starting from one minute before the 12 o'clock position, the 4 o'clock position, and the 8 o'clock position and the order Mh, Mg, Mf, and Me running clockwise from one minute before the 2 o'clock position, the 6 o'clock position, and the 10 o'clock position.

The six electrodes Hc connect together by a conductor running around their outer circumference and the six electrodes Hd connect together by a conductor at their inner circumference, as was the case with electrodes Ha and Hb respectively of FIG. 2. Conductors from the HC and HD sets run through the gap in minute electrodes between the 1 and 2 o'clock positions to connect to terminals on the other edge of plate 18b. The six electrodes Me, the six electrodes Mf, the six electrodes Mg, and the six electrodes Mh form the four sets ME, MF, MG, and MH after being connected together by a meandering pattern of conductors. The meandering pattern of conductors connects the sets together without crossovers at the cost of reversal of the order of electrodes Me, Mf, Mg, and Mh after each sequence. Each set ME, MF, MG, and MH connects to a terminal on the outer edge of plate 18b.

The FIG. 3a apparatus shows the time in a way similar to the FIG. 2a apparatus but has only 12 hour element positions. The hour hands can thus have only 12 positions and the user must remember that the hour hand always changes position on the hour or at some other preselected time. The hour elements must each cooperate with two different minute elements to show the minute hand positions. An hour element and one of the minute elements come on in turn to show each of the 24 minute positions at which a minute element is located. As in the FIG. 2a apparatus, the other minute positions are shown by also turning on an adjacent minute element to indicate one minute before or one minute after the minute hand position shown.

Timing oscillator 21, frequency divider 22, seconds register 23, and hour register 25 are the same as in FIGS. 1a and 2a. Minute register 24c is the same as minute register 24a of FIG. 2a except that it is set so that it steps five minute register 24d two minutes before the next five minute time. Five minute register 24d is the same as register 24b of FIG. 2a except that it supplies a voltage out to NAND gate 24e when in the reset condition, rather than a trigger to register 25. Gate 24e also receives the second order digit output from register 24c; so its output goes negative to step register 25 to the next hour position on the hour. With register 24c set two minutes ahead, the time reaches the hour as register 24c reaches the two minute position after register 24d reaches its reset condition.

Common electrode drive 26b is the same as drive 26a of FIG. 2 except that decoders 40b and 50b are each one of six decoders rather than one of 12 and gates sets 41b and 51b and drivers 43b are correspondingly smaller than their drive 26a counterparts. Register 25 and counter 48b provide three digit inputs to decoders 40b and 50b respectively. Drivers 43b provide tri-state outputs to energize electrodes Sb, as drivers 43 did to energize electrodes S of the FIG. 2*a* apparatus.

Hour electrode drive 27*b* is substantially the same as drive 27*a* of FIG. 2. Gates 53, 54, 63, and 64 have some changes to their inputs and so are shown individually for an easier understanding. Controls and drivers 27*x* is a block which may consist of apparatus the same as gates 55, 56, 59, 60, 61 and 62 of drive 27*a* of FIG. 2. The control input to gates 53 and 54 is the lowest order digit output of register 25, and the control input to gates 63 and 64 is the lowest order digit output of counter 48*b*. The HC set of hour electrodes Hc is energized when these digits are "0" and the HD set is energized when they are "1"s, corresponding to the even and odd hour positions respectively. The remaining difference in inputs to drive 27*b* is that gates 53 and 54 do not receive an inhibiting input from phase logic 30*b*.

Phase logic 30*b* is the same as phase logic 30*a* of FIG. 2 except that gate 74, which provided an inhibiting input to gates 53 and 54, is omitted, and the inputs are different. Comparator 70*b* receives only three digit inputs, instead of four, from register 25 and counter 48*b*. Comparator 71 receives as inputs the lowest order digits from register 25 and counter 48*b*. Shifter 29*b* is similar to shifter 29*a* of FIG. 2 except that counter 48*b* is an up/down counter and AND gate 91*c* has been added to change counter 48*b* from the count up to the count down state when minute register 24*c* holds 0. Timing signals 31*a* is the same as in FIG. 2*a* but is shown for an easier identification of signal sources.

Minute electrode drive 28*b* is substantially different from drive 28*a* of FIG. 2. AND gate 93 receives the two lowest order digit outputs from minute register 24*c* and so produces a "1" output to OR gate 94 when register 24*c* holds 3. OR gate 94 also receives the highest order digit output from register 24*c* and so produces a "1" output to Exclusive OR gate 95 when register 24*c* holds 3 or 4. AND gate 96 provides a "0" output to gate 95 except during the third ¼ second intervals when the lowest order digit in register 24*c* is a "0". The output of gate 95 is thus the same as the output of gate 94 except during the third ¼ second intervals when register 24*c* holds 0, 2, or 4. During this condition, the output of gate 95 is opposite in value to that of gate 94.

Exclusive OR gates 97 and 98 receive the output of gate 95 and the output for the lowest order digit in counter 48*b* respectively, and both receive the output for the next lowest order digit in counter 48*b*. The gate 97 and 98 outputs go to one decoder 99 of four, which provides outputs to drivers 43*c*, which may each be the same as gates 86 and 88 or gates 87 and 89 of drive 28*a* of FIG. 2*a*. The outputs of drivers 43*c* go to sets ME, MF, MG, and MH on plate 18*b*. Decoder 99 receives an enabling input from gate 79 during the second and third ¼ second intervals. The 32 hertz square wave output from gate 73 in phase logic 30*b* goes to drivers 43*c* as the signal to be passed when the tri-state amplifiers in drivers 43*c* are enabled.

Decoder 99 produces an output during the second and third ¼ second intervals which energizes the one of sets ME, MF, MG, or MH corresponding to the input combinations "00", "01", "10", or "11" respectively. The input combinations will correspond to the output of gate 94 and the output of counter 48*b* for the lowest order digit when the output of gate 96 and the output of counter 48*b* for the second lowest order digit are both "0". The output of gate 94 is "0" when register 24*c* holds 0, 1, or 2, and "1" when it holds 3 or 4. Decoder 99 will thus energize sets ME, MF, MG, and MH in turn during the second ¼ second intervals of the 10 minute period when the second lowest order digit in counter 48*b* is "0".

When the second lowest order digit output of counter 48*b* is "1", gates 97 and 98 reverse the polarity of the inputs from gate 94 and the lowest order digit in counter 48*b*. Decoder 99 then energizes sets MH, MG, MF, and ME in turn during the second ¼ second intervals of the 10 minute period when the second lowest order digit in counter 48*b* is "1". The change produced by the second lowest order digit thus compensates for the change in order of sets ME, MF, MG, and MH for successive 10 minute periods. The minute hand positions will thus be properly indicated during the second ¼ second intervals.

Gate 96 produces a "1" output during the third ¼ second intervals when the lowest order digit in register 24*c* is "0", as will be the case when the number held is 0, 2, or 4. This condition causes gate 95 to reverse the polarity of the output from gate 94 applied to gate 97 and so to decoder 99. The third ¼ second interval output from timing signals 31*a* which enables gate 96 also steps counter 48*b* through gate 91*b* when register 24*c* holds the number 0 or 4. Counter 48*b* advances one count and holds it until the end of the ¼ second interval when the number in register 24*c* is 4. Counter 48*b* retreats one count instead of advancing when register 24*c* holds 0. The 0 produces an output from gate 91*c* which changes counter 48*b* from the count-up to the count-down state.

When the number in register 24*c* is 2, it is necessary only to reverse the polarity of the gate 94 output to interchange the one of sets ME and MF or MG and MH which is energized and so turn on the adjacent minute element. When the number in register 24*c* is 0, it is necessary also to decrease the number in counter 48*b* by one to turn on the preceding minute element. Similarly, when the number in register 24*c* is 4, the number in counter 48*b* must be increased by one to turn on the following minute element. The apparatus thus functions to turn on the adjacent minute element during the third ¼ second intervals to show the time one minute before or one minute after the minute hand position.

The hour electrodes Hc and Hd and the minute electrodes Me, Mf, Mg, and Mh on plate 18*b* can, of course, be of various different shapes, as was illustrated for plate 18*a* of FIG. 2*a* by plate 18*aa* of FIG. 2*c*. A major objective is to achieve combinations of hour and minute electrodes that will represent a minute hand effectively. Plate 18*b* could have electrodes with shapes approximating those shown in FIG. 3*b*. The only change necessary would be to increase the spacing between the hour and minute electrodes to allow room for the meandering interconnection lines. The increased spacing would, of course, detract somewhat from the minute hands represented by the combinations with sequential energizing, and more from those hands composed of electrodes kept steadily energized.

Plate 18*bb* of FIG. 3*b* has hour electrodes Hc and Hd and minute electrodes Me, Mf, Mg, and Mh of a shape which provides hour and minute electrode combinations with two aligned sides. The same hour electrode Hc or Hd thus combines with either of its two adjacent minute electrodes Me, Mf, Mg, or Mh to form an artistically shaped minute hand. Instead of being interconnected as in FIG. 3*a*, each electrode has a conducting line running to the outer circumference of plate 18*bb*. The conducting lines connect to respective conducting loops HE, HD, ME, MF, MG, and MH. To avoid connections at crossover points, the loops must either be on the opposite side of plate 18bb or on another member with rubber conductor projections to contact the terminal points of the lines. Loops on the other side of plate 18bb would have to be reached by conductors feeding through holes in plate 18bb.

Instead of reversing order in successive ten minute sectors as in FIG. 3a, minute electrodes Me, Mf, Mg, and Mh maintain the same order all around the watch face. This condition requires a slight modification to the circuits of FIG. 3a, to operate with modified plate 18bb. The modification consists simply of disconnecting the inputs to gates 97 and 98 from the next to lowest order digit output from counter 48b and connecting those inputs instead to the negative supply. Or better still, gates 97 and 98 can simply be removed and the outputs from gate 95 and the lowest order digit from counter 48b can be applied directly to decoder 99. Either of these changes causes the one of minute electrode sets ME, MF, MG, or MH corresponding to the number in register 24c to be energized.

Figures 4A, 4B:
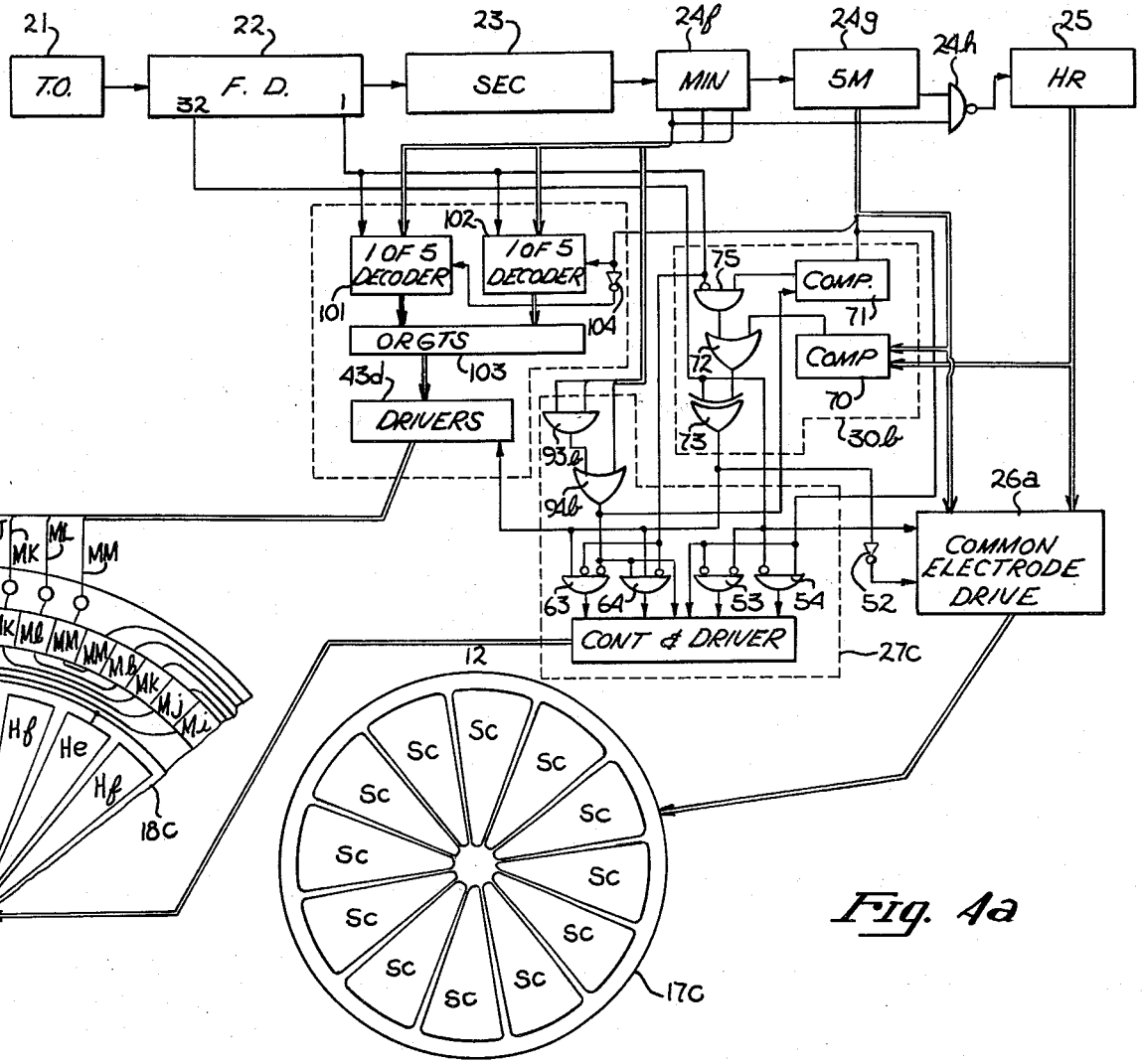
FIG. 4*a* is a partial block and partial logic schematic diagram together with plan view of fragmentary sections of display electrode plates of still another embodiment of the invention.
FIG. 4*b* is a plan view of a fragmentary portion of a display electrode plate with a different electrode pattern for a modification of the apparatus of FIG. 4*a*.

The common electrode plate 17c of FIG. 4a is the same as plate 17a of FIG. 2a except that it is rotated three degrees counter clockwise with respect to the watch face. Hour and minute electrode plate 18c has 60 minute electrodes Mi, Mj, Mk, and Ml and Mm and 24 hour electrodes He and Hf. Minute electrodes Mi through Mm reverse order in successive five minute sectors, as minute electrodes Me through Mh did in successive ten minute sectors in the apparatus of FIG. 3a, to allow connection into sets MI, MJ, MK, ML, and MM without crossovers. Minute electrodes Mi through Mm are, of course, centered on the minute positions. Hour electrodes He center on the hour or five minute positions while electrodes Hf center on the positions 2½ minutes past the five minute positions.

The apparatus of FIG. 4a shows the hour positions in the same way as the apparatus of FIG. 2a except that the in-between hour hands are at the 2½ minute positions rather than the 3 minute positions past the five minute positions. The FIG. 4a apparatus turns on the nearest hour element for the minute position ½ second each second and then turns on the proper minute element for the next ½ second each second to show the minute hand position. There is, of course, no need for also turning on adjacent minute elements as in FIG. 2a apparatus. The five minute position hour elements operate in combination with three minute elements while the 2½ minutes-past hour elements operate in combination with two minute elements to represent minute hands. The sequential turning on helps to tie the hour and minute elements together perceptually. Matching shapes for hour and minute elements will be discussed later.

The minute register 24f is set to step five minute register 24g one minute early. NAND gate 24b steps hour register 25 when register 24g resets and register 24f reaches its 1 minute position. This process is the same as in the FIG. 3a apparatus except that the offset is one minute instead of two. Common electrode drive 26a is the same as in FIG. 2a except that the five minute position input is directly from five minute register 24g rather than through counter 48. Phase logic 30b is the same as in FIG. 3a except for the sources of the input signals. The timing input to gate 75 is simply the 1 hertz signal from frequency divider 22, while the inputs to comparator 71 are the highest order digit from five minute register 24g and the output of gate 94b of hour set electrode drive 27c.

Hour electrode drive 27c is the same as drive 27b of FIG. 3a except for the input sources and the inclusion of AND gate 93b and OR gate 94b. Gate 93b receives the two lowest order digit outputs from register 24d and so has a "1" output when register 24e holds 3. Gate 94b receives the output of gate 93b and the highest order digit output from register 24f and so has a "1" output when register 24e holds 3 or 4. The output of gate 94b goes to gates 63 and 64 and to control and drivers 27x as the control for the hour electrodes for the minute position. Gates 53 and 54 along with control and drivers 27x receive the highest order digit from register 24g as the control input for the hour position. Gates 63 and 64 receive the one hertz output from frequency divider 22 on inverting inputs so that they are enabled ½ second each second. Control and drivers 27x provide outputs to hour electrode sets HE and HF.

Minute electrode drive 28c consists of one of five decoders 101 and 102, OR gate set 103, inverter 104, and drivers 43c. Decoders 101 and 102 receive the outputs of minute register 24f for decoding. Decoders 101 and 102 both receive an enabling input from the one hertz output of frequency divider 22 so that they can operate during the ½ second intervals when 63 and 64 are disabled. The lowest order digit output of register 24g goes directly to decoder 102 and through inverter 104 to decoder 101; so decoders 101 and 102 operate alternately during successive five minute intervals.

OR gate set 103 receives the outputs of decoders 101 and 102 and passes them on to the inputs of drivers 43d. As only one of decoders 101 and 102 operates at a time, gates 103 will never have more than one output at a time. Drivers 43d are the same as drivers 43c of FIG. 3a, except that there are five stages, not four. Drivers 43d provide outputs to energize minute electrode sets MI, MJ, MK, ML, and MM. When the lowest order digit output of five-minute register 24g is "0", decoder 101 operates to energize sets MI, MJ, MK, ML, and MM in turn as minute register 24f advances successively from 0 through 4. When the lowest order digit from register 24g is "1", decoder 102 operates to energize sets MM, ML, MK, MJ, and MI in turn as minute register 24e advances from 0 through 4.

The alternately used decoders 101 and 102 thus produce the reversal of order necessary to energize minute electrode sets MI, MJ, MK, ML, and MM correctly. Decoders 101 and 102 can be the same and have their outputs properly combined in OR gate set 103 to produce the desired result of energizing sets MI, MJ, MK, ML and MM during the right time intervals. If electrodes Mi, Mj, Mk, Ml, and Mm did not reverse order in successive five minute sectors, decoder 102, and OR gate set 103 could be eliminated. The outputs of the remaining decoder 101 or 102 would simply connect directly to the inputs of drivers 43d.

While sufficient space could be provided to allow conductive lines to run between adjacent minute electrodes Mi, Mj, Mk, Ml, and Mm, the area of the electrodes would have to be reduced somewhat. The output connection points for hour electrode sets He and Hf are located in the center to avoid the need for providing space between minute electrodes to take them to the outside. Plate 17c has a hole at the center to allow the connections to sets HE and HF on plate 18c to be made at the center. A member with rubber contacts can, therefore, be pushed through the hole so that the rubber contacts will press against the terminal points of the lines from sets HE and HF. A spacer between plates 17c and 18c around the outer circumference of the hole confines the liquid crystal material in the remaining cavity.

Plate 18cc of FIG. 4b shows one of the sets of shapes which can be used to match hour electrode He with three minute electrodes Mi, Mj, and Mk and hour electrode Hf with two minute electrodes Ml and Mm. The minute and hour electrodes are closely spaced leaving only enough room for the line connecting the electrodes He together into the HE set. The outputs for the HE and HF sets are brought in to the center as on plate 18c to allow the minute electrodes to be as closely spaced as possible. The minute electrodes Mi, Mj, Mk, Ml, and Mm are taken out to loops MI, MJ, MK, ML, and MM through feedthrough or other member contact points, as were the electrodes Me, Mf, Mg, and Mh of FIG. 3b. As in FIG. 3b, the same order of minute electrodes is maintained in all five minute sectors. When used with plate 18cc, decoder 102, and OR gate set 103 can be eliminated in the apparatus of FIG. 4a.

Figures 5A, 5B:
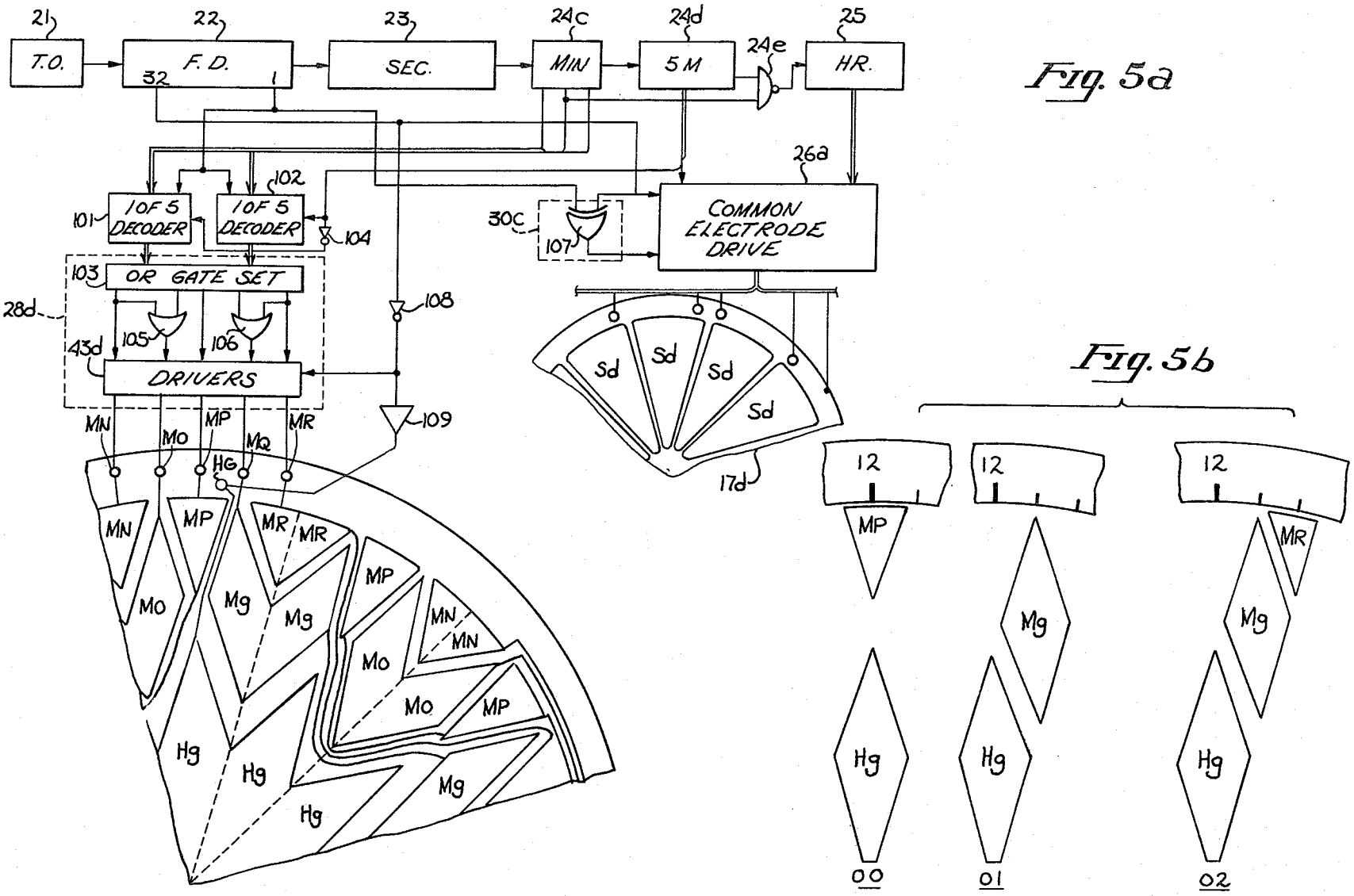
FIG. 5*a* is a partial block and partial logic schematic diagram together with views of fragmentary sections of display electrode plates of yet another embodiment of the invention.
FIG. 5*b* is a plan view of the minute hands of the apparatus of FIG. 5*a* showing three different times.

The apparatus of FIG. 5a is similar to the apparatus of FIG. 4a except that only 12 hour elements are available to show hour positions and to use as the hour element of the minute position. The single hour element for the minute position combines with specially shaped minute elements to show five different minute positions. All 60 minute positions are thus shown individually. The element for the hour position remains on continuously while the hour and minute elements for the minute position come on alternately for a half second each second. The resulting darting arrow effect assists in tying the hour and minute elements together perceptually. Two minute elements are optionally combined to show two of the five minute positions associated with an hour element.

The electrodes of plate 18d are spaced apart to allow meander-type interconnections of the minute electrodes Mn, Mo, Mp, Mq, and Mr into sets MN, MO, MP, MQ, and MR, with the order reversing in successive five minute sectors. The electrodes Mn and Mo span two five minute sectors so that only three lines are needed to make the remaining interconnections. The hour electrodes Hg are comprised of one continuous electrode with external connection made to it at the center. Plate 17d has 12 electrodes Sd, each spanning a five minute sector and centered on the respective hour positions. Plate 17d has a hole at the center, as did plate 17c of FIG. 4a, to allow contact with hour electrode HG.

The hour element which becomes visible to form the hour section of the minute hand for five different minute positions is diamond shaped; as is, of course, the element which becomes visible to show the hour position. The diamond shape is the sector of electrode Hg coextensive with an energized electrode Sd. The center minute position electrode Mp is a triangle with its base centered on the indicated minute position and its opposite apex aligned with the point of the hour element. The two electrodes Mo and Mq for the minute positions on either side of center have nearly diamond shaped parallelograms within the five minute sector which turn on to form a parallelogram shape in combination with the hour element with the external point at the indicated minute position on the dial.

The two minute electrodes Mn and Mr on the borders of the five minute sectors have triangular sectors within the five minute sector. The base of the triangle spans the minute position on the dial end. The sectors of adjacent electrodes Mo and Mq fill in the gap between the sectors of electrodes Mn and Mr respectively with the hour element. If electrode Mo is turned on with electrode Mn, and electrode Mq with electrode Mr, the combination provides a nearly rectangular shape for a more continuous minute hand representation. FIG. 5b shows the resulting representations for the center, next to center, and second from center minute positions.

The registers of FIG. 5a are the same as those of FIG. 3a in which minute register 24c is set to step five minute register 24d two minutes early, and gate 24e steps hour register 25 when register 24d is reset and register 24c reaches the two minute position. Common electrode drive 26a is the same as in the apparatus of FIG. 2a. Phase logic 30c consists of a single Exclusive OR gate 107 which reverses the phase of the 32 hertz signal applied to gate set 51 for energizing the electrode Sd for the five minute position. Electrode HG receives a phase two 32 hertz signal through inverter 108 and driver amplifier 109 at all times. Gates 41 of drive 26a have phase one applied continuously; so the hour position remains turned on continuously. The hour element for the minute position is on during the half second intervals when gate 51 also have phase one applied, and off during the half second intervals when gates 51 have phase two applied.

Minute electrode drive 28d is the same as drive 28c of FIG. 4a except that OR gates 105 and 106 have been added between the outputs of gate set 103 and two of the inputs to drivers 43d. The purpose of gates 105 and 106 is to turn on electrode set MO with electrode set MN, and electrode set MQ with electrode set MR for the first and last minute positions in each five minute sector. Gates 105 and 106 can be eliminated when the combination of two minute elements is not to be used for showing these first and last minute positions in the sector.

FIG. 5b shows minute hand positions on the hour, one minute past, and two minutes past. The hour element provided by electrode Hg at the 12 o'clock position is turned on for all three of these times as well as for one and two minutes before the hour. The minute element provided by electrode Mp at the 12 o'clock position completes the minute hand representation for on the hour. The minute element formed by the portion of electrode Mq within the five minute sector turns on to complete the minute hand for one minute after. The minute elements formed by the portions of electrodes Mq and Mr within the five minute sector turn on to complete the minute hand for the two minutes after position. It will be recognized that the minute hands for one and two minutes before are simply mirror images of those shown for one and two minutes after respectively. The appearances in the other five minute sectors is, of course, the same except for the angle of rotation about the watch face.

Figure 6:
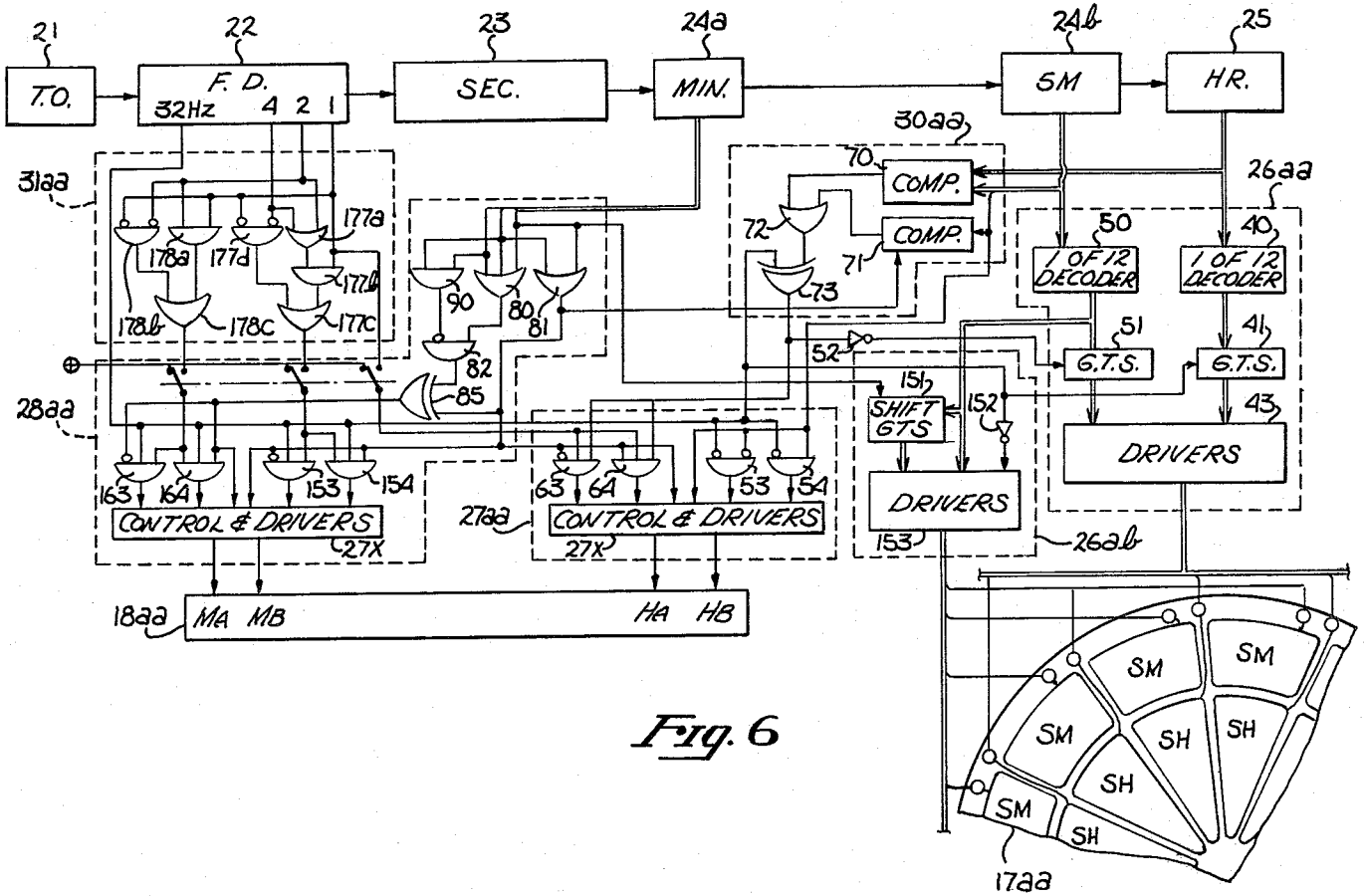
FIG. 6 is a partial block and partial logic schematic diagram together with a plan view of a display plate section for a modified form of the embodiment of FIG. 2*a*.

FIG. 6 shows a modification to the apparatus of FIG. 2a to show both hour and minute hands on steady, or to display minute hand elements in overlapping time sequence. When the hour and minute elements in the minute hand are spacially close together, the sequential turning on is unnecessary to tie them together perceptually for a good minute hand representation. When the hour and minute elements are spacially separated, however, sequential turning on does assist in perceptually tying them together. Sequential turning on with overlap retains this advantage and further provides a stronger representation of the minute hand by having both elements on together for a considerable portion of the time. With an adjacent minute element turning on periodically for minutes plus or minus the minute hand position, as in the FIG. 2*a* apparatus, the steady minute hand more positively distinguishes over the periodic adjacent minute element.

It will be recalled that the FIG. 2*a* system turned on two hour elements at the same time and then turned one of them off while the minute elements were turned on to avoid possible interference was a result of using the same common electrodes to oppose both hour and minute elements, and thereby saved on the number of pinouts required from the integrated circuit to drive the electrodes. The FIG. 6 apparatus achieves its objectives by using separate sets of common electrodes for the minute and hour elements at the cost of additional pinouts from the integrated circuit chip. By using the same phase multiplexing system as used in the FIG. 2*a* apparatus to turn on two hour elements at a time, the FIG. 6 apparatus turns on two hour elements and two minute elements at a time.

Timing oscillator 21, frequency divider 22, seconds register 23, minute register 24*a*, five minute register 24*b*, and hour register 25 are the same as in the apparatus of FIG. 2*a*. Plate 18*aa* is the same as plate 18*a* of FIG. 2*a*, while plate 17*aa* is different from plate 17*a* of FIG. 2*a*. The difference is that in plate 17*aa* each 30 degree pie-shaped section is occupied by a common minute electrode Sm and a common hour electrode Sh, just as though each electrode Se had been divided into inner and outer sections. Lines connecting the terminal points of inner common hour electrodes Sh on the outer circumference of plate 17*aa* run in between adjacent common minute electrodes Sm. Electrodes Sm and Sh will be sized and shaped to match up with minute electrodes Ma and Mb and hour electrodes Ha and Hb respectively, according to the design for a particular model.

Common hour electrode drive 26*aa* is the same as drive 26*a* of FIG. 2*a* except that the input to decoder 50 comes directly from five minute register 24*b* rather than through a counter, and an output from decoder 50 also goes to common minute drive 26*ab*. The output of drivers 43 of drive 26*aa* goes, of course, to common hour electrodes Sh. Common minute electrode drive 26*ab* consists of shift gates 151, inverter 152, and drivers 153. Drivers 153 provide outputs to energize common minute electrodes Sm in response to control inputs from decoder 50 and gates 151. When enabled by the highest order digit from minute register 24*a*, shift gates 151 perform the function of shifter 29 by passing the outputs from decoder 50 to inputs for adjacent drivers 153 with the result that another electrode Sm is energized adjacent to the one energized by the output directly from decoder 50.

Phase logic 30*aa* is the same as phase logic 30*a* of FIG. 2*a* except that gates 74 and 75 are omitted. Phase logic 30*aa* changes the phase to gates 51 and gates 63 and 64 whenever either of comparators 70 or 71 finds a match, as phase logic 30*a* did in FIG. 2*a*. Phase change is not necessary for the drive to common minute electrodes Sm, as the only two minute elements to be turned on at a time are the one at the minute position and the one adjacent. As the adjacent position always requires a different one of minute electrode sets MA or MB, one phase can be applied to both common minute electrodes Sm. Inverter 152 inverts the 32 hertz signal to drivers 153 to be opposite in phase to that applied to drivers 86 and 87 for minute electrode sets MA and MB.

Hour electrode drive 27*aa* is the same as drive 27*a* of FIG. 2*a* except that gates 53 and 54 do not receive inputs from the eliminated gate 74 and gates 63 and 64 can each have one input connected either to a positive potential or to a sequential timing input from time signals 31*aa* to obtain sequential turn on of hour and minute elements of the minute hand. The timing input is different from that of FIG. 2*a*, consisting simply of the one hertz signal from frequency divider 22 to enable gates 63 and 64 for half of each second. The remaining part of drive 27*aa* is the same as that of drive 27*a*, although the part exclusive of gates 53, 54, 63, and 64 is shown as control and drivers 27*x*, as was done in FIG. 3*a*.

Minute electrode drive 28*aa* is the same as drive 28*a* as far as gates 80, 81, 82, 85, and 90 are concerned except for no timing input to gate 82 and output from gate 81 to comparator 71. The remaining part of 28*a* of FIG. 2*a* has been replaced by an arrangement duplicating that of drive 27*aa* except for its sources of input. Gates 153, 154, 163, and 164 differ only in input source from gates 53, 54, 63, and 64 respectively, and control and drives 27*x* is the same as in drive 27*aa*. The output of gate 81 to energize the appropriate set MA or MB for the minute element of the minute hand goes to an inverted input of gate 153, directly to gate 154, and to control and drivers 27*x*. The output of gate 85 for the adjacent minute element goes to an inverted input of gate 163 and directly to gate 164 and control and drivers 27*x*.

Gates 153, 154, 163, and 164 all receive the 32 hertz output of frequency divider 22 as another of their inputs. The other inputs for gates 153, 154, 163, and 164, along with those to gates 63 and 64, can be tied to a positive potential to provide a steadily energized minute hand, or to the outputs of timing signals 31*aa* when the minute and hour elements of the minute hand and the adjacent minute element are to be sequenced. When gates 153 and 154 receive the output of timing signals 31*aa* for sequencing, they are enabled for half of each second starting $\frac{1}{8}$ of a second after the start of the enabling of gates 63 and 64 to energize the hour element of the minute hand. The output of timing signals 30*aa* enables gates 163 and 164 for a half second starting $\frac{1}{8}$ of a second after the start of the enabling of gates 153 and 154. Switch 155 is shown for making the changeover from one mode of operation to the other but in most cases one or the other mode would be selected for a particular apparatus and the connections made accordingly.

Timing signals 31*aa* operates with a frequency divider 22 which has stages that step when the preceding stage output goes negative. The one hertz output of frequency divider 22 goes to switch 155 for input to gates 63 and 64 for sequencing. Gates 63 and 64, therefore, operate for one half second each second in the sequencing mode. Timing signals 31*aa* consists of gates 177*a* through 177*d* and gates 178*a* through 178*c*. OR gate 177*a* receives the two and four hertz outputs from frequency divider 22 and so enables AND gate 177*b* to produce an output starting $\frac{1}{8}$ of a second after the start of the positive going portion of the one hertz signal and lasting for $\frac{3}{8}$ of a second. The gate 177*b* output goes to OR gate 177*c* which responds by producing an output during the $\frac{3}{8}$ second intervals. Gate 177*c* also receives an input from AND gate 177*d* which produces an output during the immediately following $\frac{1}{8}$ second intervals; so its output to gates 153 and 154 in the sequence mode lasts for one half second each second starting and ending ⅛ of a second after the start and end of the one hertz enabling input to gates 63 and 64. The output of gate 177*d* results from the application of the one and four hertz signals to inverting inputs.

AND gates 178*a* and 178*b* receive the one and two hertz signals on non-inverting and inverting inputs respectively to produce successive one quarter second outputs to OR gate 178*c*. The output of gate 178*c* is thus also positive for one half second every second starting a quarter second after the start of the positive going portion of the one hertz signal. Gates 163 and 164 are thus enabled ⅛ of a second later than gates 153 and 154 and a quarter second later than gates 63 and 64 on sequencing.

The use of separate hour and minute common electrodes thus allows the hour and minute hand indications to be on continuously, or the minute hand to be sequenced in an overlapping manner to give a stronger impression of the minute hand. It will be recognized by those skilled in the art that similar changes could be made to the apparatus of FIGS. 3*a*, 4*a*, and 5*a*.

Figure 7:
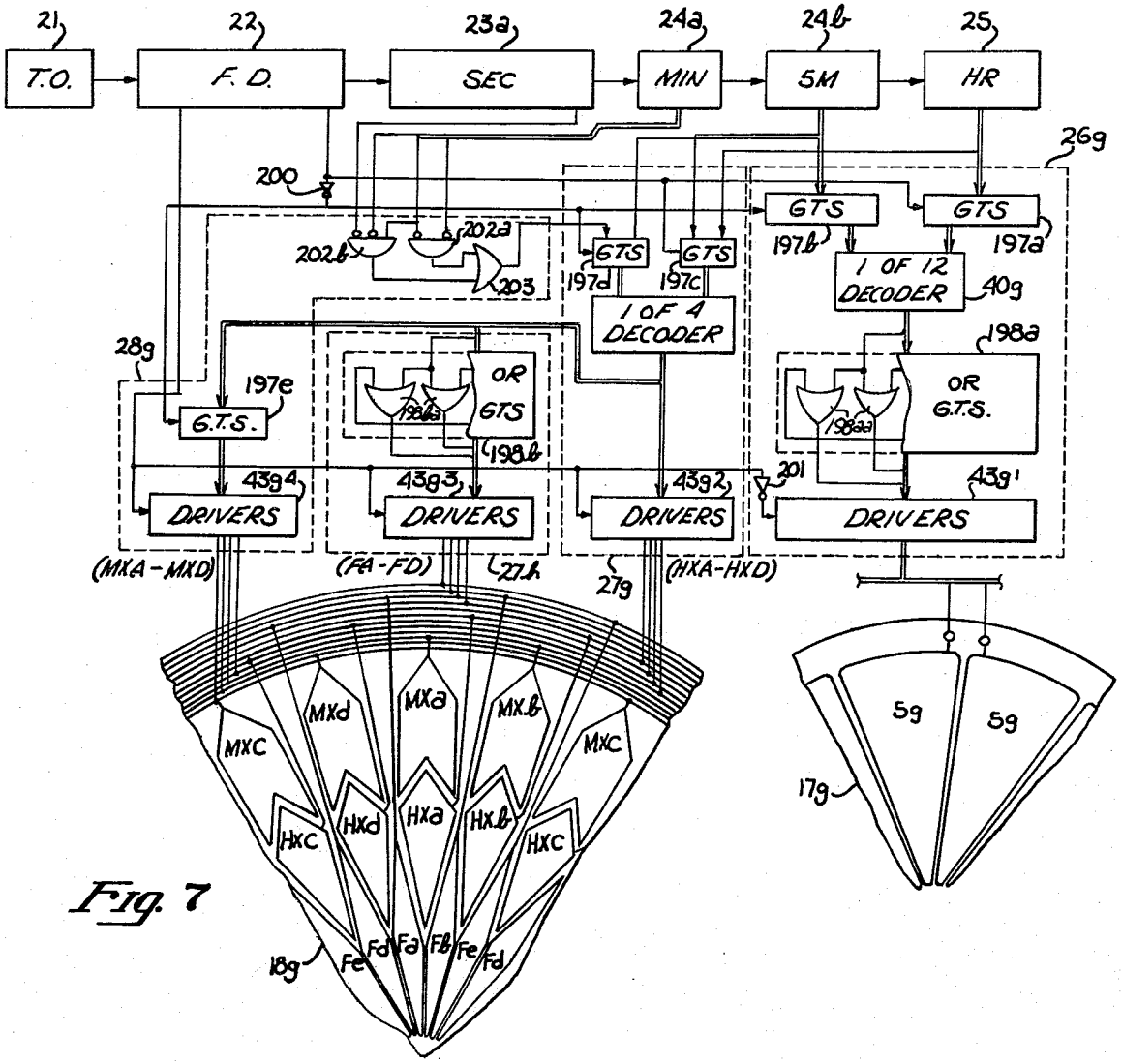
FIG. 7 is a partial block and partial logic schematic diagram together with a plan view of a fragmentary section of a display plate for another modified form of the embodiment of FIG. 2*a*.

The embodiment of FIG. 7 uses a combination of elements to form hour hands which more nearly approach conventional hour hands in appearance and which have increased area for improved visibility. The pie-shaped segments, whose boundaries are the outer boundaries possible for the hour hands of the previous embodiments, become increasingly restrictive toward the center. The combinations for the hour hands at different positions overcome the restrictions by permitting two or more hands to use the same element and so effectively share the same area. The increased area, especially toward the interior, increases both visibility and the possibilities for effective artistic design. The larger areas for the same angular segments at the outer circumference provide plenty of room for matching minute hand designs.

The FIG. 7 apparatus is concerned with illustrating the combination of elements to form better hour hands to show the hour and to combine with minute sections for minute hands. The apparatus uses 24 minute elements, 24 basic hour elements and 24 auxiliary hour elements to show 24 hour and minute hand positions. To avoid further complexities, the apparatus alternates the hour and minute hand presentations and shows the time to within 2½ minutes only. It will be recognized by those skilled in the art that the features of other embodiments could be combined with those of this embodiment. Showing the hour and minute hands at the same time and energizing the adjacent minute elements to show time to the minute would require more electrodes, more sets for for the hour electrodes, and more circuit complexity.

Electrode plate 18*g* of FIG. 7 has 24 minute electrodes Mxa through Mxd connected in four sets MXA through MXD. Plate 18*g* further has 24 hour electrodes Hxa through Hxd connected in four sets HXA through HXD and 24 auxiliary hour electrodes Fa through Fd connected in four sets FA through FD. Electrodes Mxa, Mxc, Hxa, and Hxc are centered on the hour or five minute positions; and electrodes Mxb, Mxd, Hxb, and Hxd are centered in between at the 2½ minutes past the five minute positions. Electrodes Fa through Fd interlace with electrodes Hxa through Hxd starting with electrode Fa lacing between electrodes Hxd and Hxa. Lines from all electrodes go to the outer circumference to connect to the conductive loops for the respective sets.

The hour hand presentation consists of a combination of one of electrodes Hxa through Hxd with the two of electrodes Fa through Fd which are adjacent to it. It will be noted that the outer sides of the adjacent electrodes Fa through Fd run parallel to what would be the radius through the middle of the hour element. The combination thus results in a rectangle running radially inward roughly half the length of the Fa through Fd electrodes. From the half way point, the outer boundaries of electrodes Fa through Fd run radially into the center. The area of the combination is considerably greater than that possible for the hour electrodes Ha and Hb of plate 18*a* in FIG. 2*a*. The shape of the combination also more closely approximates that of the hour hand of a conventional watch. The minute electrodes Mxa through Mxd continue the generally rectangular shape for more conventional minute hand shapes. It will be recognized, additionally, that many other shapes could be designed to fit within the expanded boundaries.

Timing oscillator 21, frequency divider 22, minute register 24*a*, five minute register 24*b*, and hour register 25 are the same as in FIG. 2*a*. The first section of seconds register 23*a* divides by 15 or 30, so that the last stage of register 23*a* is a binary divider to provide for an output in each state for one half minute intervals. The other embodiments could, of course, have used register 23*a* as well as other configurations. Common electrode drive 26*g*, hour electrode driver 22*g*, and minute electrode drive 28*g* are different from their corresponding counterparts in other embodiments. Auxiliary electrode drive 27*h* is an additional component split off from drive 27*g*. Plate 17*b* is the same as that used in the apparatus of FIG. 2*a* except that it is rotated so that the boundaries between electrodes Sg are located between the hour or five minute positions and the middle or 2½ minutes past positions.

Common electrode drive 26*g* consists of gates 197*a* and 197*b*, one of 12 decoder 40*g*, OR gates 198*a* and drivers 43*g*1. Gates 197*a* receives the one hertz output of frequency divider 22 as its control input and gates 197*b* receives the one hertz signal through inverter 200. Gates 197*a* and 197*b* thus apply the contents of hour register 25 and five minute register 24*b* respectively to decoder 40*g* during alternate half second intervals. The outputs of decoder 40*g* go to OR gates 198*a* which produce two outputs in response to each output from decoder 40*g*. The two outputs of OR gates 198*a* in response to a decoder 40*g* output go to drivers 43*g*1 which then produce outputs to energize a corresponding two of electrodes Sg of plate 17*g*.

OR gates 198*a* consists of 12 OR gates 198*aa* each receiving two outputs of decoder 40*g* as inputs. Each decoder 40*g* output goes to gates 198*aa* which produce outputs to drivers 43*g*1 to energize two adjacent electrodes Sg of plate 17*g*. When register 25 or register 24*b* reaches the 12 o'clock position, for example, the resulting outputs energize the electrodes Sg whose boundaries are 7½ degrees clockwise from the 12 o'clock position. This combination enables the turning on of the elements at the 12 o'clock and 2½ minutes past positions. Drivers 43*g*1 receive the 32 hertz signal from frequency divider 22 through inverter 201 to produce outputs opposite in phase to the outputs of drivers 43*g*2, 43*g*3, and 43*g*4 of drives 27*g*, 27*h*, and 28*g* respectively. Drivers 43*g*1 through 43*g*4 consist of sets of tri-state amplifiers and two-way clamping gates such as amplifiers 86 and 87 and gates 88 and 89 of FIG. 2*a*.

Hour electrode drive 27*g* consists of gates 197*c* and 197*d*, one of four decoder 199, and drivers 43*g*2. Gates 197*c* and 197*d* receive the one hertz and inverted one hertz signals to operate with gates 197*a* and 197*b* respectively. Gates 197*c* and 197*d* apply outputs for the hour position and the minute position respectively to decoder 199, which in turn provides an output to turn on one of drivers 43*g*2. Drivers 43*g*2 provide outputs to energize electrode sets HXA through HXD. The hour position information is the lowest order digit from hour register 25 and the highest order digit from five minute register 24*b*. If desired, the highest order digit from register 24*b* could be replaced with the output of a decoder having one state when the number in register 24*b* is from 0 to 30 minutes past the hour and another when the number is from 30 to 0 minutes past, as previously discussed. The minute position information input to gates 197*d* consists of the lowest order digit output from five minute register 24*b* and a decoded output from drive 28*g* which is in one state when minute register 24*a* and seconds register 23*a* hold numbers for the time from 0 to 2½ minutes, and in another state when the registers hold numbers for from 2½ to 0 minutes.

The one of sets HXA through HXD energized corresponds to the hour position when gates 197*a* and 197*c* are operated and to the minute position when gates 197*b* and 197*d* are operated. Sets HXA and HXC are energized when the hour is from 0 to 40 minutes past and the minutes 0 to 2½ minutes past during the respective intervals. Sets HXB and HXD are energized when the hour is from 40 to 60 (or 0) minutes past and the minutes 2½ to 5 (or 0) minutes respectively. The outputs of decoder 199 also go to auxiliary hour electrode drive 27*h* and to minute electrode drive 28*g*. Drive 27*h* produces outputs to energize the appropriate pair of sets FA through FD adjacent to the energized one of sets HXA through HXD. Drive 28*g* produces an output to energize the one of sets MXA through MXD corresponding in position to the one of sets HXA through HXD respectively energized during the one half second intervals for the minute hand.

Drive 27*h* consists of OR gates 198*b* and drivers 43*g*3. Gates 198*b*, like gates 198*a* of drive 26*g*, produce two outputs to drivers 43*g*3 for each input received. The two outputs cause drivers 43*g*3 to energize the pair of electrode sets FA through FD on either side of the set HXA through HXD being energized. The result is the turning on of the area of electrodes Fa through Fd adjacent to the area of the electrode Hxa through Hxd turned on.

Drive 28*g* consists of gates 197*e*, drivers 43*g*4, AND gates 202*a* and 202*b*, and OR gate 203. Gates 197*e* pass the output of decoder 199 to drivers 43*g*4 during the minute hand intervals. The result is the energizing of the one of sets MXa through MXD corresponding to the minute position, which in turn turns on the one of elements Mxa through Mxd to complete the minute hand.

Gate 202*a* produces an output when the highest order digits held by minute register 24*a* are both "0"s. This occurs for the numbers 0 and 1. Gate 202*b* produces an output during the first half minute while register 24*a* is holding a 2. The output of second register 23*a* limits the output of gate 202*b* to the first half minute. OR gate 203 will thus have an output for 2½ minutes after register 24*a* reaches the 0 position. The output of gate 203 to gates 197*d* as one of the bits for the minute position information.

What I claim is:

1. In an electronic timepiece having a time register and a time display consisting of a plurality of electro-optical elements disposed in first and second loops on the face of said timepiece, the combination of:

(a) first means responsive to the minute position held in said time register for activating one of said elements in said first loop;

(b) second means responsive to the minute position held in said time register for activating one of said elements in said second loop; and (c) means for operating said first and second activating means in sequence repetitively at a perceptible rate.

2. The combination according to claim 1 wherein the number of said elements in said first and second loops is each less than 60; including third means responsive to the minute position held in said time register for activating another of said elements in said second loop; and wherein said operating means also operates said third activating means in sequence with said first and second activating means.

3. The combination according to claim 1 wherein said timepiece includes a high frequency timing element and a frequency divider interposed between said timing element and said time register; and wherein said operating means responds to signals from said frequency divider.

4. In an electronic timepiece having a time register and a time display consisting of a plurality of electro-optical display elements disposed in first and second loops on the face of said timepiece, the combination of:

(a) first means responsive to the hour position held in said time register for enabling the activation of an element in said first loop;

(b) second means responsive to the minute position held in said time register for enabling the activation of an element in said first loop;

(c) third means responsive to the minute position held in said time register for enabling the activation of an element in said second loop;

(d) first means for activating the elements enabled by said first enabling means; and (e) second means for activating the elements enabled by said second and third enabling means in sequence repetitively at a perceptible rate.

5. The combination according to claim 4 wherein the number of elements in said second loop is less than 60 and including third means responsive to the minute positions held in said time register which are different than the minute positions corresponding to said elements in said second loop for activating another element in said second loop.

6. The combination according to claim 5 wherein said another element activated by said third activating means is always adjacent to the element enabled by said third enabling means and said second and third activating means operate in sequence repetitively at a perceptible rate.

7. The combination according to claim 6 wherein said another element activated by said third activating means is positioned with respect to the element enabled by said third enabling means in a clockwise direction when the time is one minute past and in a counterclockwise direction when the time is one minute before the time represented by the position of the element enabled by said third enabling means.

8. The combination according to claim 4 wherein the number of elements in said second loop is an integral multiple of the number of elements in said first loop and wherein each of the elements in said first loop is enabled by said second enabling means during the same interval that a plurality of elements in said second loop are enabled in turn by said third enabling means.

9. In an electronic timepiece having a time register and a time display which includes a layer of electro-optical material together with means for supporting activating electrodes on both sides of said layer, the combination of:

(a) a plurality of first electrodes arranged in a first loop in proximity to one side of said layer of electro-optical material;

(b) a plurality of second electrodes arranged in a second loop in proximity to the other side of said layer and substantially coextensive with said first loop, said second electrodes being smaller than said first electrodes and connected together in sets such that only one member of each set is coextensive with any one of said first electrodes;

(c) first means responsive to a first quantity in said time register for producing a first operative voltage difference between one of said first electrodes and one of said sets of second electrodes to activate a first display element;

(d) second means responsive to a second quantity in said time register for producing a second operative voltage difference between one of said first electrodes and one of said sets of second electrodes to activate a second display element; and (e) means for controlling the relationship between the outputs of said first and second producing means whereby said outputs have a first relationship to each other when each is applied to a different one of said first electrodes and to a different one of said sets of second electrodes and a second relationship to each other when said first and second producing means apply a voltage to the same one of said first electrodes or to the same set of second electrodes.

10. The combination according to claim 9 wherein said first and second producing means apply alternating voltages to produce said first and second operative voltage differences respectively and wherein said controlling means determines the phase of the alternating voltage applied by said second producing means so it is opposite to that applied by said first producing means except when said first and second producing means apply a voltage to the same one of said first electrodes or the same set of said second electrodes.

11. The combination according to claim 10 including means for applying a potential midway between the peaks of said alternating voltages to all of said first electrodes and all of said sets of second electrodes not receiving voltages from said first or second producing means.

12. In an electronic timepiece having a time register and a display which presents hour and minute hand positions on the face of said timepiece and includes a layer of electro-optical material together with means for supporting activating electrodes on both sides of said layer, the combination of:

(a) a plurality of first electrodes arranged in a first loop in proximity to one side of said layer of electro-optical material;

(b) a plurality of second electrodes arranged in a second loop in proximity to the other side of said layer and connected together in a plurality of first sets wherein only one member of each set is within the area coextensive with any one of said first electrodes;

(c) a plurality of third electrodes arranged in a third loop in proximity to said other side of said layer and connected together in a plurality of second sets wherein only one member of each set is within the area coextensive with any one of said first electrodes;

(d) first means responsive to the hour position held in said time register for producing a first operative voltage difference between one of said first electrodes and one of said first sets of second electrodes to alter the optical characteristics of said layer to present an hour hand position;

(e) second means responsive to the minute position held in said time register for producing a second operative voltage difference between one of said first electrodes and one of said first sets of second electrodes and a third operative voltage difference between said same one of said first electrodes and one of said second sets of third electrodes to alter the optical characteristics of said layer to present a minute hand position; and (f) means responsive to the relation between the hour and minute positions in said time register for controlling the relationship between the outputs of said first and second producing means to apply voltages which do not conflict and which have a first relationship to each other when said first and second producing means are both energizing the same one of said first electrodes or the same one of said sets of second electrodes and a second relationship when said first and second producing means are energizing different ones of said first electrodes and different ones of said sets of second electrodes.

13. The combination according to claim 1 wherein said second producing means produces said second and third operative voltage differences in sequence repetitively at a perceptible rate.

14. The combination according to claim 1 wherein the number of said second electrodes and the number of said third electrodes are both less than 60; and including third means responsive to the minute position held in said time register for producing a fourth operative voltage difference between another of said second sets of third electrodes and one of said first electrodes.

15. The combination according to claim 14 wherein said second and third producing means operate in sequence repetitively at a perceptible rate.

16. The combination according to claim 1 wherein the number of said second electrodes is a divisor of 60: and wherein said second producing means produces said second operative voltage difference between said first electrode and the same one of said first sets of second electrodes for each of a plurality of minute positions in said time register.

17. The combination according to claim 12 wherein said first and second producing means each applies square waves of opposite phase to produce said first, second, and third operative voltage differences.

18. The combination according to claim 17 wherein said controlling means determines which phases said first and second producing means applies to said first electrodes.

19. The combination according to claim 18 wherein said controlling means causes the phase applied to said first electrode by said first producing means to be opposite to the phase applied to said first electrode by said second producing means except when said first and second producing means are applying voltage to the same one of said first electrodes or the same first set of said second electrodes.

20. The combination according to claim 17 including tri-state stages having their outputs connected to said first electrodes and said first and second sets of second and third electrodes respectively and receiving control and signal inputs from said first and second producing means.

21. The combination according to claim 20 wherein said output stages include two-way conduction gates which hold the outputs midway between the most negative and most positive voltage outputs when not receving control inputs from said first or second producing means to produce square wave outputs.

22. The combination according to claim 16 wherein the number of said third electrodes is a multiple of the number of said second electrodes; and wherein said second producing means produces said third operative voltage difference between one of said first electrodes and successive ones of said second sets of third electrodes in turn with successive minute positions in said time register; and wherein said second producing means produces said second and third voltage differences in sequence repetitively at a perceptible rate.

* * * * *